US006944309B2

(12) United States Patent
Terai et al.

(10) Patent No.: US 6,944,309 B2
(45) Date of Patent: Sep. 13, 2005

(54) HEADPHONE SYSTEM

(75) Inventors: Kenichi Terai, Osaka (JP); Hiroyuki Hashimoto, Osaka (JP); Isao Kakuhari, Osaka (JP); Hiroshi Hamanaka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 728 days.

(21) Appl. No.: 09/776,480

(22) Filed: Feb. 2, 2001

(65) Prior Publication Data

US 2001/0031062 A1 Oct. 18, 2001

(30) Foreign Application Priority Data

Feb. 2, 2000 (JP) ..... 2000-025786

(51) Int. Cl.[7] ..... H04R 5/02

(52) U.S. Cl. ..... 381/309; 381/310; 381/374; 381/380

(58) Field of Search ..... 381/309, 310, 381/311, 74, 370, 371, 374, 380

(56) References Cited

U.S. PATENT DOCUMENTS 3,796,840 A 3/1974 Ohta
3,943,304 A * 3/1976 Piribauer ..... 381/372
3,984,885 A 10/1976 Yoshimura et al.
4,821,323 A 4/1989 Papiernik
5,333,206 A * 7/1994 Koss ..... 381/370
5,684,879 A 11/1997 Verdick
5,761,314 A 6/1998 Inanaga et al.
6,356,644 B1 * 3/2002 Pollak ..... 381/371
6,603,863 B1 * 8/2003 Nagayoshi ..... 381/380

FOREIGN PATENT DOCUMENTS

| | | |
|---|---|---|
| DE | 26 080 908 A1 | 9/1977 |
| JP | 49-39002 | 10/1974 |
| KR | 0124394 | 9/1997 |
| KR | 1999-358 | 10/1999 |
| WO | WO95/20866 | 8/1995 |

OTHER PUBLICATIONS

Copy of Korean Office Action dated May 27, 2003.

* cited by examiner

*Primary Examiner*—Stella Woo
(74) *Attorney, Agent, or Firm*—Snella & Wilmer L.L.P.

(57) ABSTRACT

A headphone system includes a headphone; and a signal processing circuit for outputting an acoustic signal to the headphone. The headphone includes a first speaker and a third speaker for a right ear of a listener, a second speaker and a fourth speaker for a left ear of the listener, and a support for supporting the first through fourth speakers so that the first and second speakers are located forward with respect to a vertical plane including a straight line connecting the hole of the right ear and the hole of the left ear of the listener, the second and fourth speakers are located rearward with respect to the vertical plane, and the first through fourth speakers are out of contact with the right ear and the left ear of the listener.

13 Claims, 19 Drawing Sheets

201
20
400
401
4
31
2
8
3
30
1

201
31
2
30
1

201
400
4
401
2

HEADPHONE SYSTEM

BACKGROUND OF THE INVENTION

1. Field of the Invention

The present invention relates to a headphone system for reproducing a multi-channel acoustic signal.

2. Description of the Related Art

Recently, as multi-media systems such as DVD systems have become commonplace, more and more multi-channel acoustic information has been provided together with video.

Conventionally, systems for virtually reproducing a multi-channel acoustic signal using a headphone have been proposed.

For example, International Publication WO95/20866 discloses a technology for filtering signals which are input to right and left speakers, so as to cause a sound source provided in front of or behind the listener to be recognized or perceived by the listener.

FIG. 19 shows a structure of a headphone system described in International Publication WO95/20866.

The headphone system shown in FIG. 19 includes a right ear speaker 1901 and a left ear speaker 1902. The speakers 1901 and 1902 are fixed at positions distanced from the listener. The headphone system further includes filters 1910 and 1911. Reference numeral 1960 represents a virtual sound source located behind the listener.

In FIG. 19, H1 indicates a transfer function from the virtual sound source 1960 to the right ear of the listener. H2 indicates a transfer function from the virtual sound source 1960 to the left ear of the listener. Transfer function H1 is set in the filter 1910, and transfer function H2 is set in the filter 1911.

An input signal Z is input to the filters 1910 and 1911. The output from the filter 1910 is input to the right ear speaker 1901, and the output from the filter 1911 is input to the left ear speaker 1902.

Thus, the listener can recognize the virtual sound source 1960.

It is relatively easy for a human being to correctly recognize the sound source to his/her right or left. The reason for this is that he/she has ears on the right side and the left side of the head. It is considered that a human being recognizes the sound source to his/her right or left based on a plurality of different types of information, including the time period required by the signal from the sound source to reach his/her left ear, the time period required by the signal from the sound source to reach his/her right ear, and the difference in the signal levels. Therefore, there is little difference among individuals in the ability to recognize or distinguish between a sound source to his/her right or left.

It is relatively difficult for a human being to correctly recognize or distinguish between a sound source in front of or behind him/her. The reason for this is that there is little difference between the time period required by the signal from the sound source to reach his/her right ear and the time period required by the signal from the sound source to reach his/her left ear. It is considered that a human being recognizes or distinguishes between a sound source in front of or behind him/her based on a single piece of information of the absolute value of the frequency spectrum of the sound source. Since the head-related transfer function from the sound source to the ears is different among individuals due to each person's individual shape of the head, there is a relatively large difference among individuals in the ability to recognize a sound source located in front of or behind the listener.

Using the conventional technology shown in FIG. 19, the sound from a sound source located in front of or behind the listener is transferred to him/her by the combination of the right ear and left ear speakers 1901 and 1902 and the filter processing. Using such technology, it is difficult to cause the listener to correctly recognize a sound source located in front of or behind him/her, due to the individual difference in the transfer function. Especially for high frequencies, the difference between different individuals' recognition of front/rear sound direction is undesirably large, because the influence of differences between different individuals' transfer functions on such recognition is greater for high frequencies than it is for low frequencies.

SUMMARY OF THE INVENTION

A headphone system according to the present invention includes a headphone; and a signal processing circuit for outputting an acoustic signal to the headphone. The headphone includes a first speaker and a third speaker for a right ear of a listener, a second speaker and a fourth speaker for a left ear of the listener, and a support for supporting the first through fourth speakers so that the first and second speakers are located forward with respect to a vertical plane including a straight line connecting the hole of the right ear and the hole of the left ear of the listener, the third and fourth speakers are located rearward with respect to the vertical plane, and the first through fourth speakers are out of contact with the right ear and the left ear of the listener.

In one embodiment of the invention, the signal processing circuit outputs an acoustic signal, for causing the listener to recognize a front sound source located forward with respect to the listener, to the first and second speakers.

In one embodiment of the invention, the signal processing circuit outputs an acoustic signal, for causing the listener to recognize a rear sound source located rearward with respect to the listener, to the third and fourth speakers.

In one embodiment of the invention, the signal processing circuit outputs, among acoustic signals for causing the listener to recognize a rear sound source, acoustic signals having a frequency of a prescribed frequency fi or lower to the first and second speakers, and outputs acoustic signals having a frequency of the prescribed frequency fi or higher to the third and fourth speakers.

In one embodiment of the invention, the signal processing circuit outputs, among acoustic signals for causing the listener to recognize a front sound source, acoustic signals having a frequency of a prescribed frequency fi or higher to the first and second speakers, and outputs acoustic signals having a frequency of the prescribed frequency fi or lower to the third and fourth speakers.

In one embodiment of the invention, the first and second speakers are located rearward with respect to a vertical plane including a straight line connecting a right eye and a left eye of the listener.

In one embodiment of the invention, the third speaker is located so that an angle between a straight line straight ahead direction of the listener and a vertical line running through the center of a front surface of the third speaker is in the range of about 100 degrees to about 120 degrees, and the fourth speaker is located so that an angle between the straight line in the straight ahead direction of the listener and a vertical line running through the center of a front surface of the fourth speaker is in the range of about 100 degrees to about 120 degrees.

In one embodiment of the invention, the headphone further includes a low frequency-dedicated speaker for reproducing only audio signals in a low frequency band.

In one embodiment of the invention, the low frequency-dedicated speaker is located in the vicinity of a rear part of the head of the listener, when the headphone is worn.

In one embodiment of the invention, the low frequency-dedicated speaker is located in the vicinity of the top of the head of the listener, when the headphone is worn.

In one embodiment of the invention, the headphone further includes a vibration unit for vibrating based on a dedicated low frequency band signal used for reproducing only audio signals in a low frequency band, and the vibration unit is supported so as to be in close contact with a temporal region of the head of the listener, when the headphone is worn.

In one embodiment of the invention, the support includes a first supporting member for supporting the first and third speakers and a second supporting member for supporting the second and fourth speakers. The third speaker and the first supporting member are connected through a first connecting portion so that the third speaker is rotatable about the first connecting portion. The fourth speaker and the second supporting member are connected through a second connecting portion so that the fourth speaker is rotatable about the second connecting portion.

In one embodiment of the invention, the headphone further includes a first reflection plate for reflecting sound radiating from the third speaker and a second reflection plate for reflecting sound radiating from the fourth speaker. The third speaker is located so that a surface of a diaphragm of the third speaker includes a straight line connecting the hole of the right ear of the listener and the center of the third speaker, and the sound radiating from the third speaker and reflected by the first reflection plate reaches the right ear of the listener. The fourth speaker is located so that a surface of a diaphragm of the fourth speaker includes a straight line connecting the hole of the left ear of the listener and the center of the fourth speaker, and the sound radiating from the fourth speaker and reflected by the second reflection plate reaches the left ear of the listener.

Thus, the invention described herein makes possible the advantage of providing a headphone system for reproducing a multi-channel acoustic signal so that the listener can correctly recognize or perceive a virtual sound source in front of or behind the listener regardless of the individual difference in the recognizing ability.

These and other advantages of the present invention will become apparent to those skilled in the art upon reading and understanding the following detailed description with reference to the accompanying figures.

DESCRIPTION OF THE EMBODIMENTS

Hereinafter, the present invention will be described by way of illustrative examples with reference to the accompanying drawings.

EXAMPLE 1

A headphone system 101 according to a first example of the present invention will be described with reference to FIGS. 1A through 3.

The headphone system 101 includes a headphone 201 and a signal processing circuit for outputting an acoustic signal to the headphone 201.

Figures 1A, 1B, 1C:
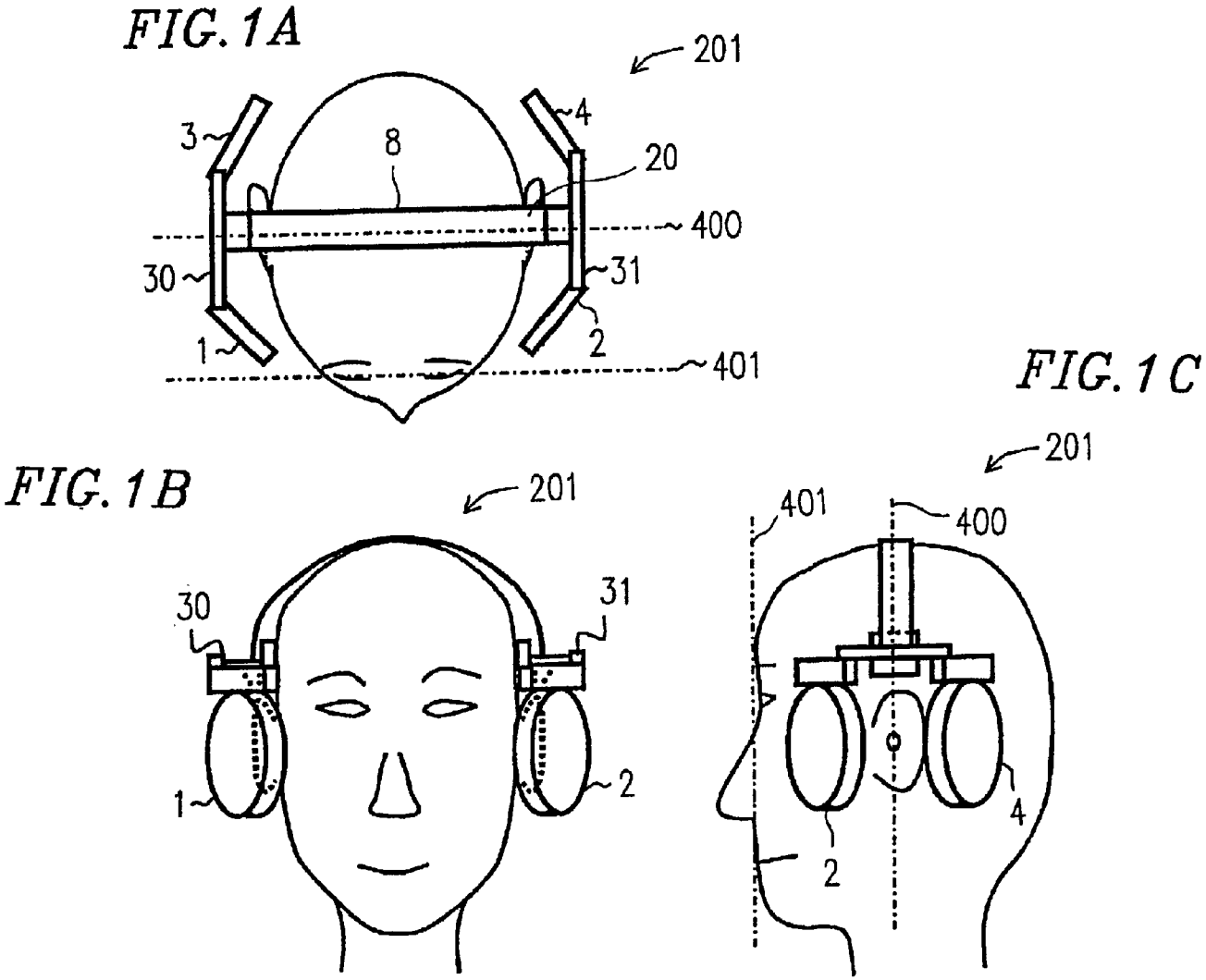
FIGS. 1A, 1B and 1C are a top view, a front view and a side view of a headphone 201 according to a first example of the present invention.

FIGS. 1A, 1B and 1C show a structure of the headphone 201. FIG. 1A is a top view, FIG. 1B is a front view, and FIG. 1C is a side view of the headphone 201.

As shown in FIG. 1A, 1B and 1C, the headphone 201 includes right ear speakers 1 and 3, left ear speakers 2 and 4, and a support 8 for supporting the speakers 1 through 4.

The support 8 includes, for example, a headphone band 20 and speaker supporting members 30 and 31. The support 8 supports the speakers 1 through 4 so as to fulfill the following conditions (1) through (3).

Condition (1): The speakers 1 and 2 are located forward with respect to a vertical plane represented by the chain line 400 in FIGS. 1A and 1C. The vertical plane represented by the chain line 400 is defined as a vertical plane which includes a straight line connecting the right ear hole and the left ear hole of the listener. The vertical plane represented by the chain line 400 will be referred to as the "vertical plane 400" for convenience.

Condition (2): The speakers 3 and 4 are located rearward with respect to the vertical plane 400.

Condition (3): The speakers 1 through 4 are located out of contact with the right and left ears of the listener.

The speaker supporting member 30 supports the speakers 1 and 3, and the speaker supporting member 31 supports the speakers 2 and 4. The speaker supporting members 30 and 31 are connected to each other by the headphone band 20. The support 8 may have any other structure or shape as long as the support 8 supports the speakers 1 through 4 so as to fulfill the above conditions (1) through (3).

By the above-described location of the speakers 1 through 4, the speakers 1 and 3 respectively have acoustically independent enclosures, and the speakers 2 and 4 also respectively have acoustically independent enclosures. Therefore, an acoustic signal from the speaker 1 and an acoustic signal from the speaker 3 independently reach the right ear of the listener along the shape of the head of the listener. Similarly, an acoustic signal from the speaker 2 and an acoustic signal from the speaker 4 independently reach the left ear of the listener along the shape of the head of the listener. This means that information on the transfer function in front of and behind the individual listener is provided to the listener. As a result, the listener can correctly recognize a virtual sound source in front of or behind him/her regardless of the difference in different individuals' recognizing abilities.

Figure 2:
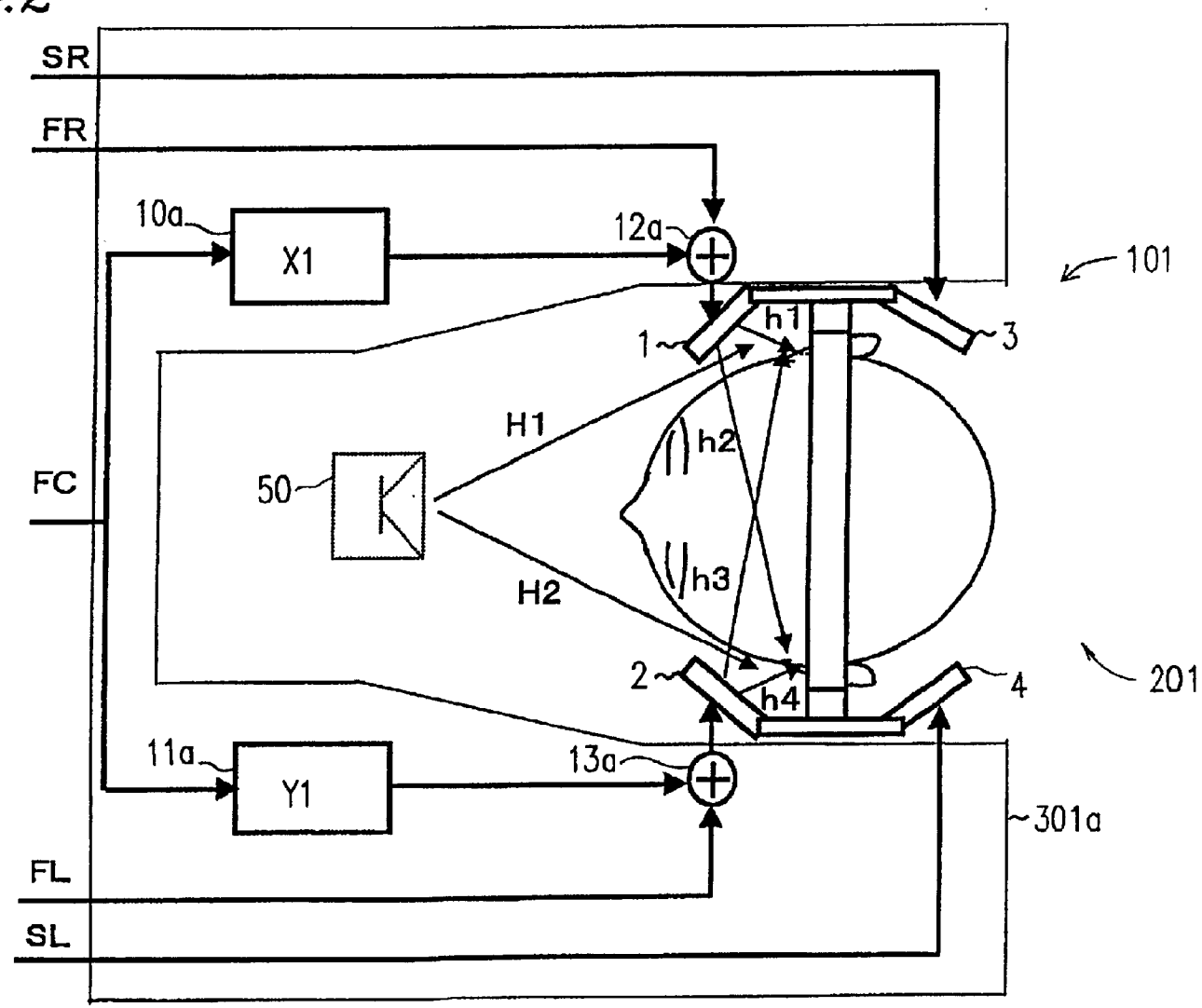
FIG. 2 is a block diagram of a headphone system 101 according to the first example of the present invention, illustrating a structure of a signal processing circuit 301*a;*

FIG. 2 shows a structure of a signal processing circuit 301*a*. The signal processing circuit 301*a* is one example of such a circuit usable in the headphone system 101. The signal processing circuit 301*a* outputs an acoustic signal to the speakers 1 and 2 for causing the listener to recognize a sound source in front of the listener.

In FIG. 2, reference numeral 50 represents a front center sound source indicated by the dotted line in front of the listener. The front center sound source 50 is not really present but is a virtual sound source which is recognized to be present by the listener. Hereinafter, the front center sound source 50 will be referred to as the "virtual sound source 50".

The signal processing circuit 301*a* receives, as input signals, a front right signal (FR signal), a front left signal (FL signal), a front center signal (FC signal), a rear right signal (SR signal), and a rear left signal (SL signal). The signal processing circuit 301*a* processes these input signals to generate an acoustic signal, and outputs the acoustic signal to the headphone 201.

The signal processing circuit 301*a* includes filters 10*a* and 11*a*, and adders 12*a* and 13*a*.

The filter 10*a* processes the FC signal. The adder 12*a* adds the FC signal processed by the filter 10*a* and the FR signal. The addition result is output to the speaker 1.

The filter 11*a* also processes the FC signal. The adder 13*a* adds the FC signal processed by the filter 11*a* and the FL signal. The addition result is output to the speaker 2.

The SR signal is output to the speaker 3, and the SL signal is output to the speaker 4.

A transfer function X1 of the filter 10*a* and a transfer function Y1 of the filter 11*a* are designed to fulfill the following expressions (1) and (2). By thus designing the transfer functions X1 and Y1, the listener can correctly recognize the virtual sound source 50.

$$h1 \cdot X1 + h3 \cdot Y1 = H1 \quad \text{expression (1)}$$

$$h2 \cdot X1 + h4 \cdot Y1 = H2 \quad \text{expression (2)}$$

Here, H1 is the transfer function from the virtual sound source 50 to the right ear hole of the listener, and H2 is the transfer function from the virtual sound source 50 to the left ear hole of the listener. Furthermore, h1 is the transfer function from the speaker 1 to the right ear hole of the listener, h2 is the transfer function from the speaker 1 to the left ear hole of the listener, h3 is the transfer function from the speaker 2 to the right ear hole of the listener, and h4 is the transfer function from the speaker 2 to the left ear hole of the listener.

From expressions (1) and (2), X1 is represented by expression (3) and Y1 is represented by expression (4).

$$X1 = (h4 \cdot H1 - h3 \cdot H2)/(h1 \cdot h4 - h2 \cdot h3) \quad \text{expression (3)}$$

$$Y1 = (h1 \cdot H2 - h2 \cdot H1)/(h1 \cdot h4 - h2 \cdot h3) \quad \text{expression (4)}$$

The transfer functions H1, H2, and h1 through h4 are measured with a specific listener. The specific listener may be an existent listener or a virtual listener.

In the case where a listener other than the specific listener (for example, listener A) uses the headphone 201 including the filters 10*a* and 11*a* designed based on the transfer functions H1, H2, and h1 through h4 measured with the specific listener, a transfer function H1' from the virtual sound source 50 to the right ear hole of the listener A is represented by expression (5).

$$\begin{aligned} H1' &= h1' \cdot X1 + h3' \cdot Y1 \\ &= h1' \cdot \{(h4 \cdot H1 - h3 \cdot H2)/(h1 \cdot h4 - h2 \cdot h3)\} \\ &\quad + h3' \cdot \{(h1 \cdot H2 - h2 \cdot H1)/(h1 \cdot h4 - h2 \cdot h3)\} \\ &= \{(h1' \cdot h4 - h2 \cdot h3') \cdot H1 \\ &\quad + (h1 \cdot h3' - h1' \cdot h3) \cdot H2\}/(h1 \cdot h4 - h2 \cdot h3) \end{aligned} \quad \text{expression (5)}$$

Here, h1' is the transfer function from the speaker 1 to the right ear hole of the listener A, and h3' is the transfer function from the speaker 2 to the right ear hole of the listener A.

Based on expression (6), expression (5) is changed to expression (7).

$$h1' \cdot h4 - h2 \cdot h3' >> h1 \cdot h3' - h1' \cdot h3 \quad \text{expression (6)}$$

$$H1' \approx \{(h1' \cdot h4 - h2 \cdot h3')/(h1 \cdot h4 - h2 \cdot h3)\} \cdot H1 = (1 + \Delta h1) \cdot H1 \quad (7)$$

Similarly, a transfer function H2' from the virtual sound source 50 to the left ear hole of the listener A is represented by expression (8).

$$H2' = (1 + \Delta h2) \cdot H2 \quad \text{expression (8)}$$

Figure 19:
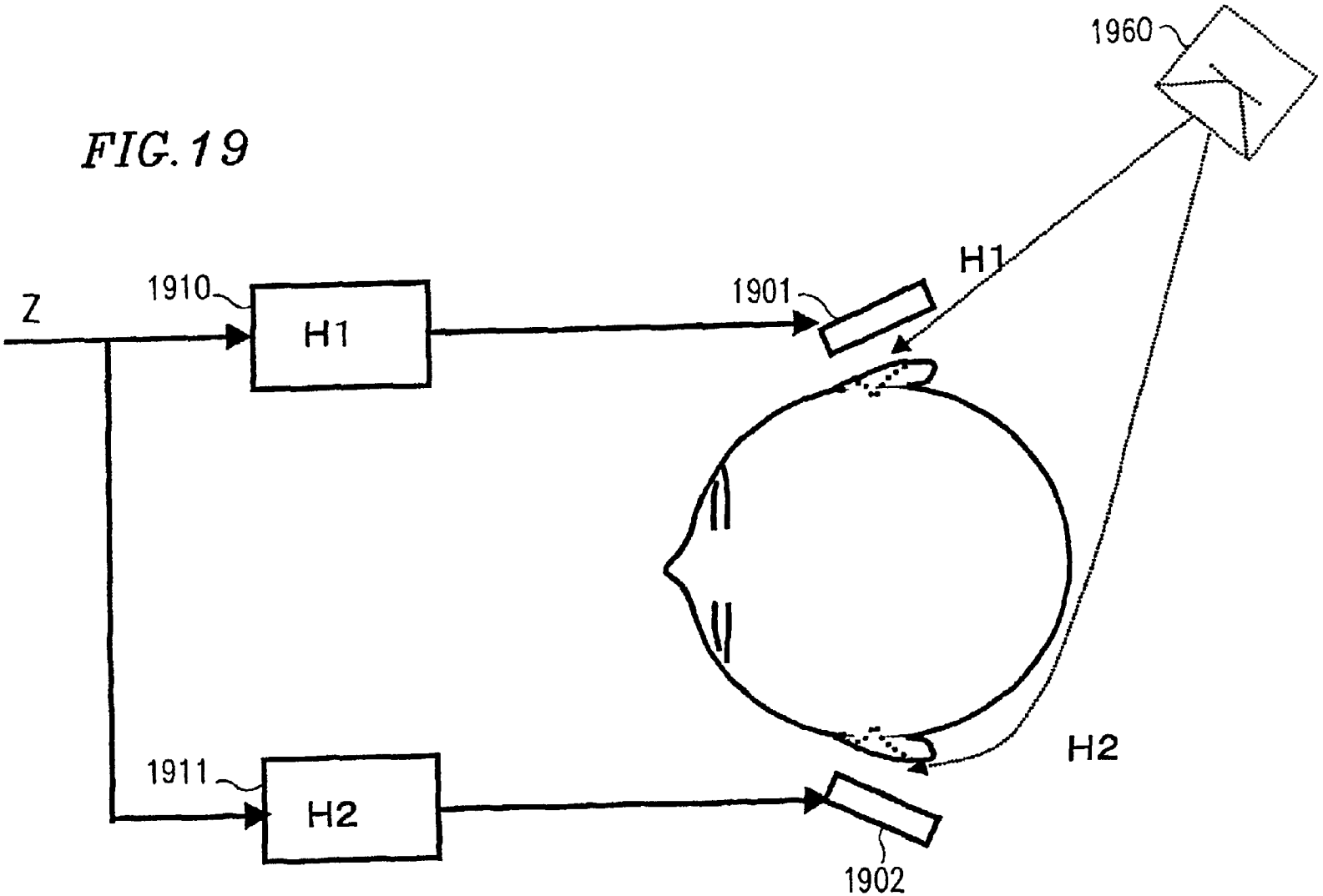
FIG. 19 shows a structure of a conventional head phone system.

Δh1 and Δh2 act as correction coefficients for correcting the individual difference of the listener A from the above-mentioned specific listener. In this manner, the headphone system 101 can allow any listener to recognize the virtual sound source 50 more correctly than conventional headphone systems which merely implement the transfer functions H1 and H2 (for example, the conventional headphone system shown in FIG. 19).

The above-described technique for correcting the individual difference among different listeners is used in common with all the examples described below.

Figure 3:
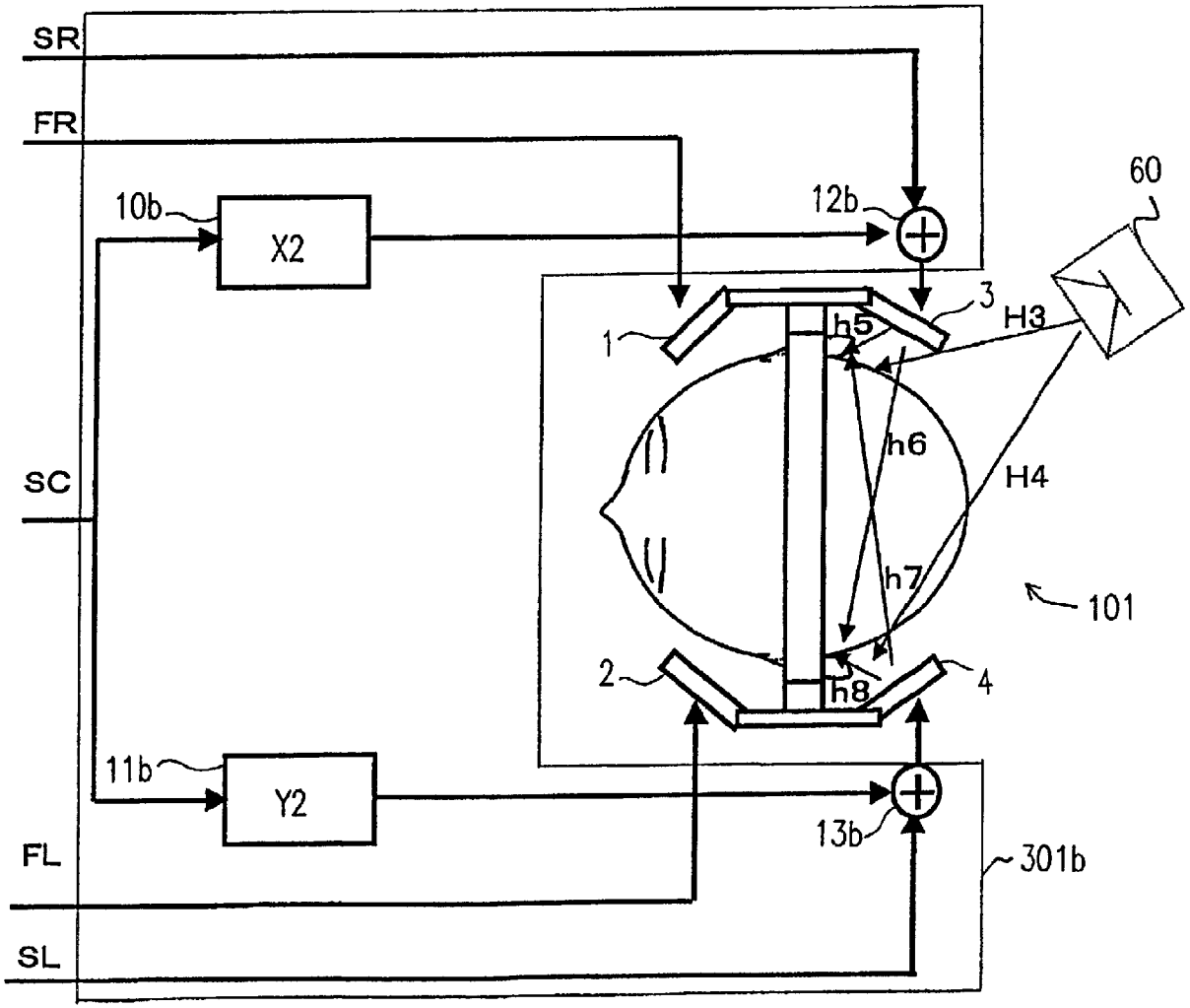
FIG. 3 is a block diagram of the headphone system 101 according to the first example of the present invention, illustrating a structure of a signal processing circuit 301*b;*

FIG. 3 shows a signal processing circuit 301*b*. The signal processing circuit 301*b* is another example of such a circuit usable in the headphone system 101. The signal processing circuit 301*b* outputs an acoustic signal to the speakers 3 and 4 for causing the listener to recognize the sound source behind the listener.

In FIG. 3, reference numeral 60 represents a rear sound source indicated by the dotted line behind the listener. The rear sound source 60 is not really present but is a virtual sound source which is recognized to be present by the listener. Hereinafter, the rear sound source 60 will be referred to as the "virtual sound source 60".

The signal processing circuit 301*b* receives, as input signals, a front right signal (FR signal), a front left signal (FL signal), a rear center signal (SC signal), a rear right signal (SR signal), and a rear left signal (SL signal). The signal processing circuit 301*b* processes these input signals to generate an acoustic signal, and outputs the acoustic signal to the headphone 201.

The signal processing circuit 301*b* includes filters 10*b* and 11*b*, and adders 12*b* and 13*b*.

The filter 10*b* processes the SC signal. The adder 12*b* adds the SC signal processed by the filter 10*b* and the SR signal. The addition result is output to the speaker 3.

The filter 11*b* also processes the SC signal. The adder 13*b* adds the SC signal processed by the filter 11*b* and the SL signal. The addition result is output to the speaker 4.

The FR signal is output to the speaker 1, and the FL signal is output to the speaker 2.

A transfer function X2 of the filter 10*b* and a transfer function Y2 of the filter 11*b* are designed to fulfill the following expressions (9) and (10). By thus designing the transfer functions X2 and Y2, the listener can correctly recognize the virtual sound source 60.

$$h5 \cdot X2 + h7 \cdot Y2 = H3 \quad \text{expression (9)}$$

$$h6 \cdot X2 + h8 \cdot Y2 = H4 \quad \text{expression (10)}$$

Here, H3 is the transfer function from the virtual sound source 60 to the right ear hole of the listener, and H4 is the transfer function from the virtual sound source 60 to the left ear hole of the listener. Furthermore, h5 is the transfer function from the speaker 3 to the right ear hole of the listener, h6 is the transfer function from the speaker 3 to the left ear hole of the listener, h7 is the transfer function from the speaker 4 to the right ear hole of the listener, and h8 is the transfer function from the speaker 4 to the left ear hole of the listener.

From expressions (9) and (10), X2 is represented by expression (11) and Y2 is represented by expression (12).

$$X2 = (h8 \cdot H3 - h7 \cdot H4)/(h5 + h8 - h6 \cdot h7) \quad \text{expression (11)}$$

$$Y2 = (h5 \cdot H4 - h6 \cdot H3)/(h5 \cdot h8 - h6 \cdot h7) \quad \text{expression (12)}$$

As described above, in the headphone system 101 according to the first example of the present invention, an acoustic signal for causing the listener to recognize the sound source in front of the listener is reproduced using the speakers 1 and 2 located forward with respect to the vertical plane 400 (FIGS. 1A and 1C), and the sound source behind the listener is reproduced using the speakers 3 and 4 located rearward with respect to the vertical plane 400.

The information on the sound source in front of the listener is provided to the listener through the individual transfer functions which are set in accordance with the shape of the head of the listener in the direction from the sound source to the listener. The information on the sound source behind the listener is also provided to the listener through the individual transfer functions which are set in accordance with the shape of the head of the listener in the direction from the sound source to the listener. As a result, the listener can correctly recognize a sound source in front of or behind him/her regardless of the differences between different individuals' recognizing abilities.

The speakers 1 and 2 provided forward with respect to the vertical plane 400 (FIGS. 1A and 1C) are preferably located rearward with respect to a vertical plane represented by the chain line 401. The vertical plane represented by the chain line 401 is defined as a plane which is parallel to the vertical plane 400 and includes a straight line connecting the right eye and the left eye of the listener. The vertical plane represented by the chain line 401 will be referred to as the "vertical plane 401" for convenience. The above-described location of the speakers 1 and 2 prevents the speakers 1 and 2 from being in the field of vision of the listener. As a result, the listener can enjoy the video displayed on the large-scale screen without being disturbed by the speakers 1 and 2.

EXAMPLE 2

A headphone system 102 according to a second example of the present invention will be described with reference to FIGS. 4A through 7.

The headphone system 102 includes a headphone 202 (FIGS. 4A through 4C) and a signal processing circuit 302 (FIG. 7) for outputting an acoustic signal to the headphone 202.

Figure 4A:
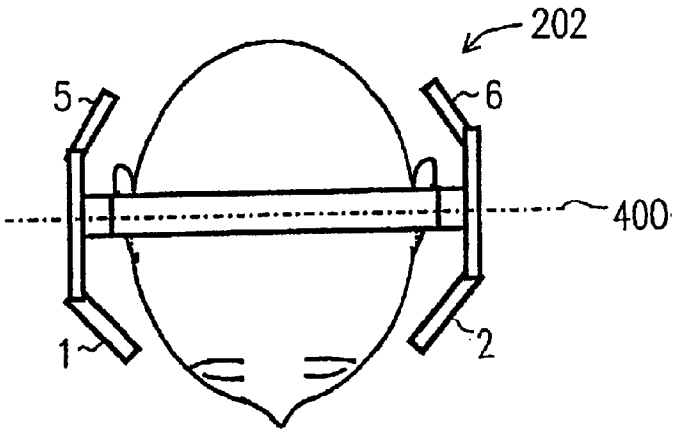
FIGS. 4A, 4B and 4C are a top view, a front view and a side view of a headphone 202 according to a second example of the present invention.
Figure 4B:
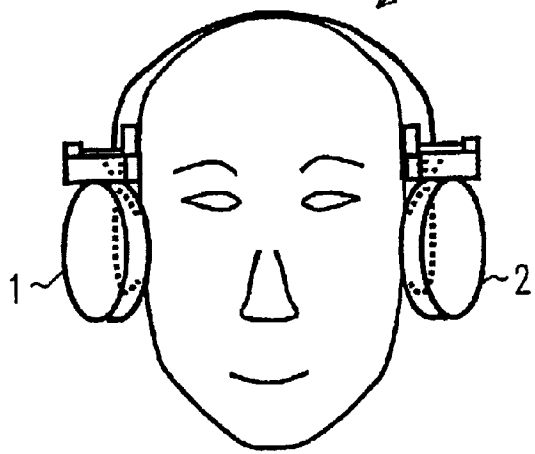
Figure 4C:
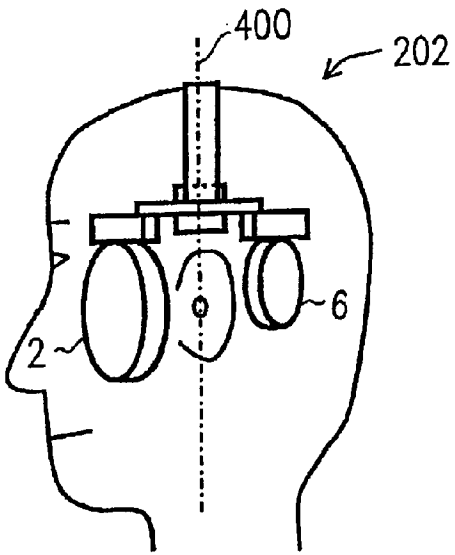

FIGS. 4A, 4B and 4C show a structure of the headphone 202. FIG. 4A is a top view, FIG. 4B is a front view, and FIG. 4C is a side view of the headphone 202.

As shown in FIG. 4A, 4B and 4C, the headphone 202 includes right ear speakers 1 and 5, left ear speakers 2 and 6, and a support 8 for supporting the speakers 1, 2, 5 and 6.

As in the first example, the support 8 supports the speakers 1, 2, 5 and 6 so as to fulfill the following conditions (1) through (3).

Condition (1): The speakers 1 and 2 are located forward with respect to the vertical plane 400.

Condition (2): The speakers 5 and 6 are located rearward with respect to the vertical plane 400.

Condition (3): The speakers 1, 2, 5 and 6 are located out of contact with the right and left ears of the listener.

According to the second example of the present invention, among acoustic signals for causing the listener to recognize a sound source located behind the listener, acoustic signals having a frequency of a prescribed frequency fi or lower, are reproduced using the speakers 1 and 2 located forward with respect to the vertical plane 400. Among the acoustic signals for causing the listener to recognize a sound source located behind the listener, acoustic signals having a frequency of a prescribed frequency fi or higher, are reproduced using the speakers 5 and 6 located rearward with respect to the vertical plane 400. An acoustic signal having the prescribed frequency may be reproduced either using the speakers 1 and 2 or the speakers 5 and 6.

The prescribed frequency fi is preferably defined as the upper limit of the frequency band in which there is substantially no difference between the transfer function from a sound source in front of the listener to the right (or left) ear of the listener (hereinafter, referred to as the "front transfer function") and the transfer function from a sound source behind the listener to the right (or left) ear of the listener (hereinafter, referred to as the "rear transfer function"). In other words, the differences between the transfer functions is almost zero.

Using such a system in which a part of the acoustic signals for causing the listener to recognize a sound source located behind the listener are reproduced using the speakers 1 and 2, the speakers 5 and 6 can be reduced in size and weight.

In this system, the acoustic signals for causing the listener to recognize a sound source located in front of the listener are reproduced using the speakers 1 and 2 which are located forward with respect to the vertical plane 400.

A difference between the front transfer function and the rear transfer function occurs because the shape of the head of the listener is asymmetric in the front-rear direction and the shape of the ears of the listener is asymmetric in the front-rear direction. However, the shape of the head and the shape of the ears are physically different in the front half and the rear half by merely a few centimeters or less.

The above-mentioned prescribed frequency fi can be specified in consideration of the relationship between the wavelength and the frequency of the acoustic signals. According to the second example, the prescribed frequency fi is set at, for example, about 1 kHz to about 3 kHz.

The difference in the size of the head or the ears among individuals is merely a few centimeters or less. Accordingly, the frequency at which the transfer functions starts to differ due to the individual difference almost matches the prescribed frequency fi.

Figure 5:
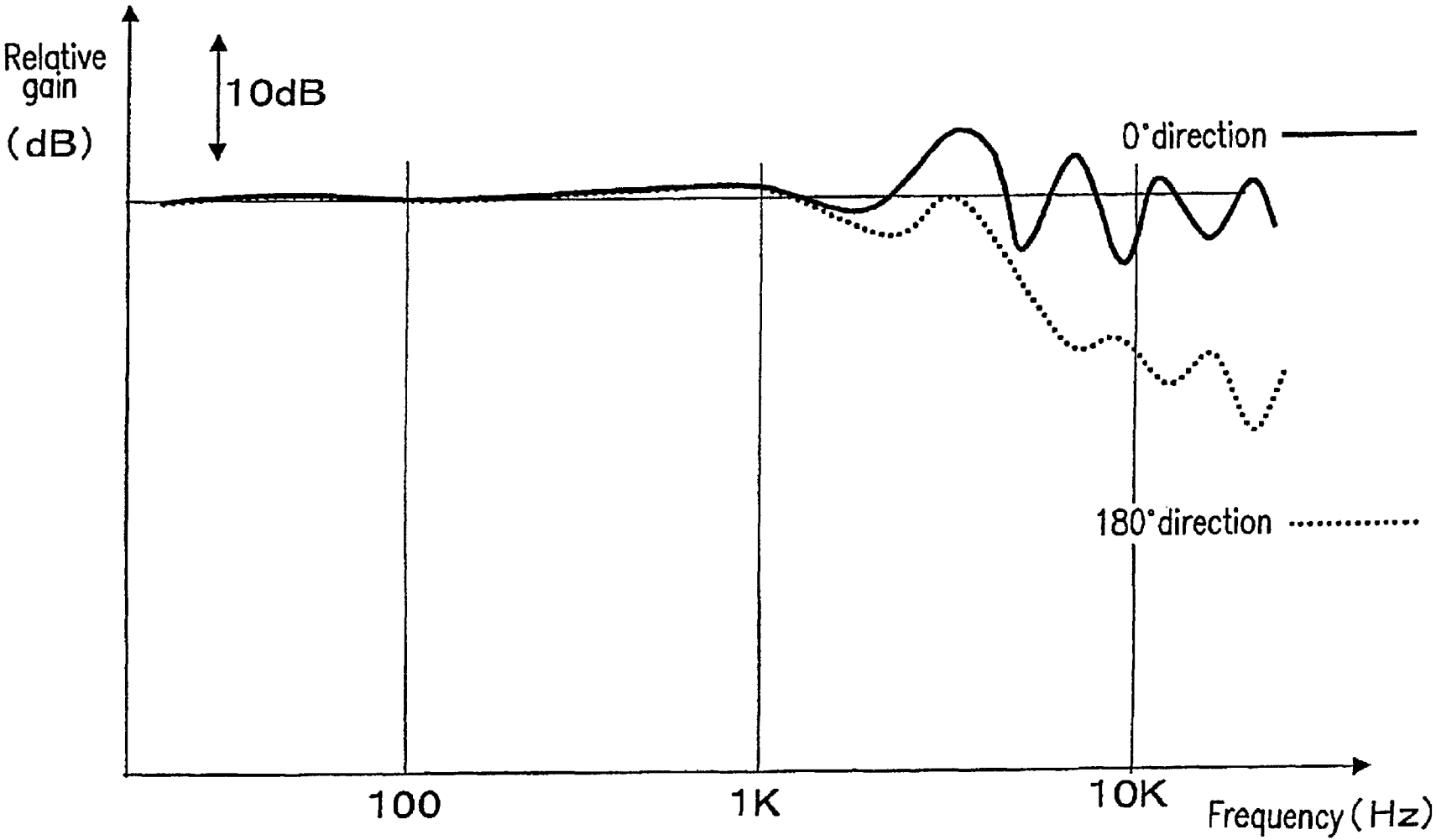
FIG. 5 is a graph illustrating an example of the front transfer function and the rear transfer function regarding a specific listener.

FIG. 5 is a graph illustrating one example of the front transfer function and the rear transfer function regarding a specific listener. The solid line represents an example of the head-related transfer function in the 0° direction (the direction straight ahead of the listener), and the dotted line represents an example of the head-related transfer function in the 180° direction (the direction directly behind the listener).

From the example shown in FIG. 5, it will be appreciated that the front transfer function and the rear transfer function are largely different from each other in the frequency band of about 1 kHz or more.

Figure 6:
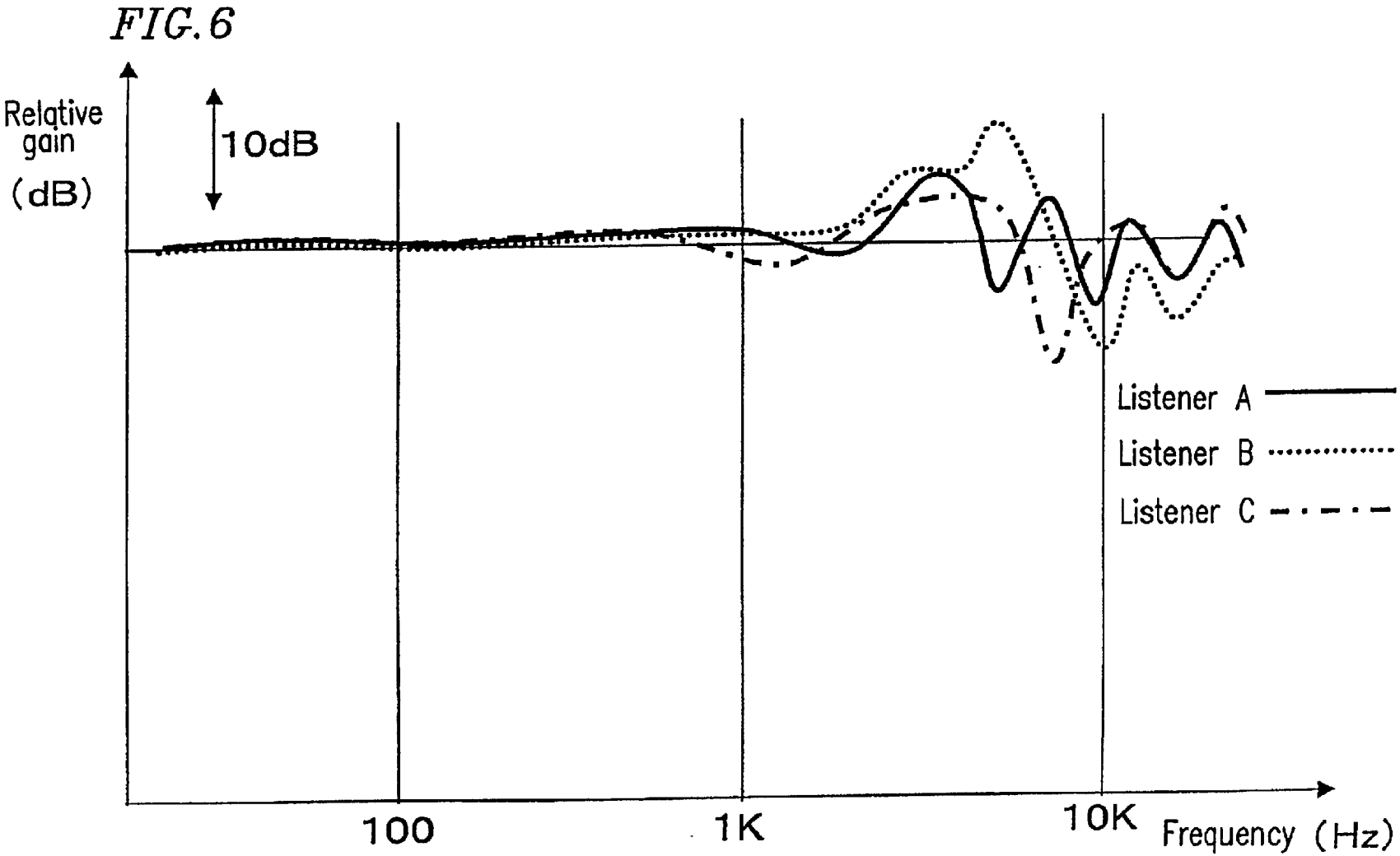
FIG. 6 is a graph illustrating an example of the individual difference in the head-related transfer function.

FIG. 6 is a graph illustrating one example of the individual difference in the head-related transfer function in the 0° direction (the direction straight ahead of the listeners). The solid line represents an example of the head-related transfer function of listener A, the dotted line represents an example of the head-related transfer function of listener B, and the chain line represents an example of the head-related transfer function of listener C.

From the example shown in FIG. 6, it will be appreciated that the head-related transfer functions of the three listeners are also largely different from one another in the frequency band of about 1 kHz or more.

In the examples shown in FIGS. 5 and 6, it is desirable to set the prescribed frequency fi at about 1 kHz. By reproducing the acoustic signals having the prescribed frequency fi or lower (in which there is substantially no difference in the head-related transfer function regardless of the direction or the listener) using the speakers 1 and 2, the speakers 5 and 6 can have a smaller diaphragm and a more-lightweight magnetic circuit.

Figure 7:
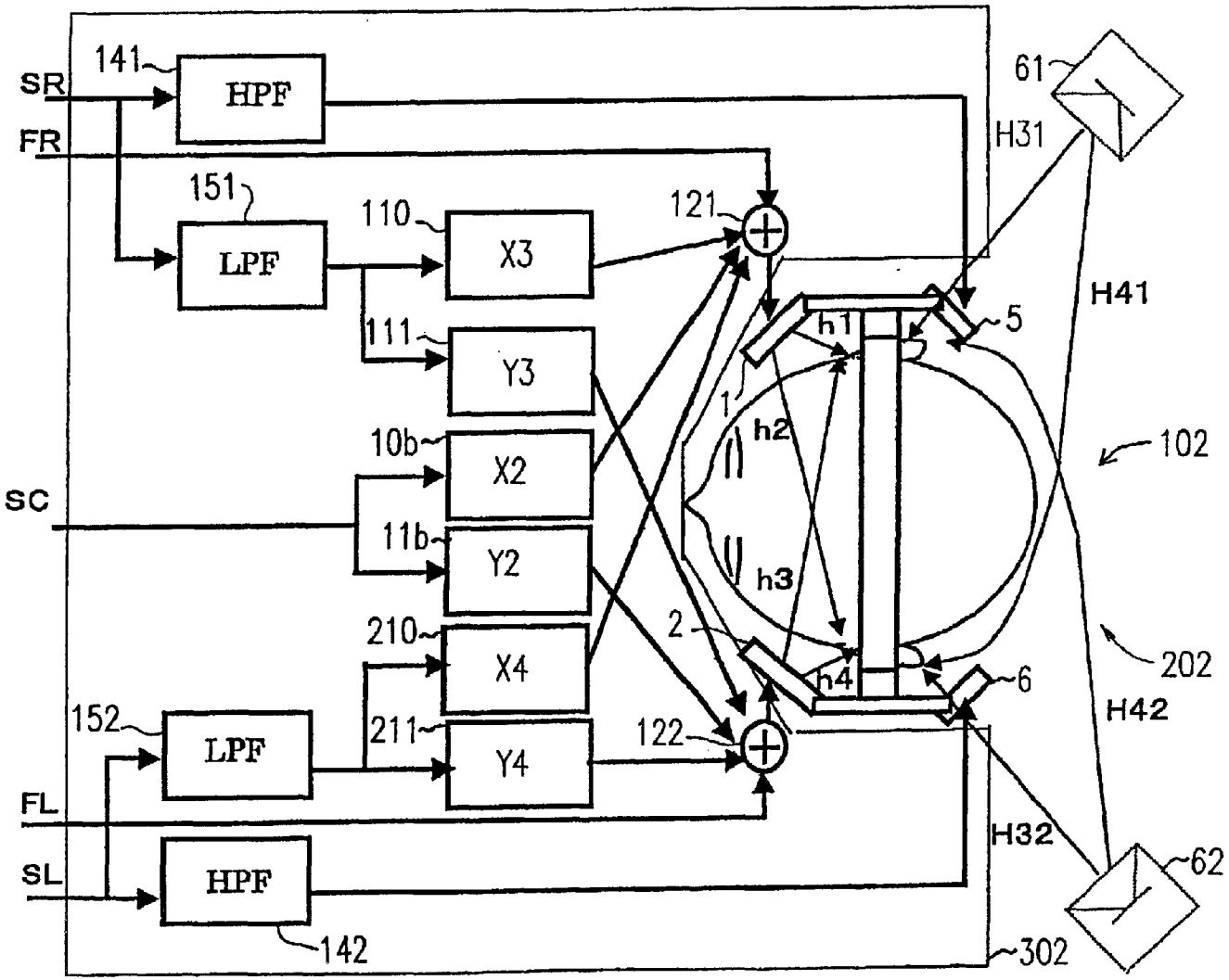
FIG. 7 is a block diagram of a headphone system 202 according to the second example of the present invention, illustrating a structure of a signal processing circuit 302.

FIG. 7 shows a structure of the signal processing circuit 302. The signal processing circuit 302 outputs, among acoustic signals for causing the listener to recognize a sound source behind the listener, acoustic signals having a frequency of fi or lower to the speakers 1 and 2. The signal processing circuit 302 outputs, among the acoustic signals for causing the listener to recognize a sound source behind the listener, acoustic signals having the frequency of fi or higher to the speakers 5 and 6.

In FIG. 7, identical elements previously discussed with respect to FIG. 3 bear identical reference numerals and the descriptions thereof will be omitted.

The signal processing circuit 302 includes high pass filters (HPF) 141 and 142 for allowing signals having a frequency component of fi or higher, and low pass filters (LPF) 151 and 152 for allowing signals having the frequency component of fi or lower. The signal processing circuit 302 also includes the filters 110, 111, 10*b*, 11*b*, 210 and 211, and adders 121 and 122.

In FIG. 7, reference numerals 61 and 62 both represent virtual sound sources. In this example, the virtual sound source 61 is to the rear right of the listener, and the virtual sound source 62 is to the rear left of the listener.

The SR signal is input to the speaker 5 through the HPF 141. The SR signal is also input to the LPF 151. The output from the LPF 151 is input to the filters 110 and 111.

The SL signal is input to the speaker 6 through the HPF 142. The SL signal is also input to the LPF 152. The output from the LPF 152 is input to the filters 210 and 211.

The SC signal is input to the filters 10*b* and 11*b*.

The adder 121 adds the FR signal, the output from the filter 110, the output from the filter 10*b*, and the output from the filter 210. The addition result is output to the speaker 1.

The adder 122 adds the FL signal, the output from the filter 111, the output from the filter 11*b*, and the output from the filter 211. The addition result is output to the speaker 2.

A transfer function X3 of the filter 110 and a transfer function Y3 of the filter 111 are designed to fulfill the following expressions (13) and (14). By thus designing the transfer functions X3 and Y3, the listener can correctly recognize the virtual sound source 61.

$$X3=(h4\cdot H31-h3\cdot H41)/(h1\cdot h4-h2\cdot h3) \quad \text{expression (13)}$$

$$Y3=(h1\cdot H41-h2\cdot H31)/(h1\cdot h4-h2\cdot h3) \quad \text{expression (14)}$$

Here, H31 is the transfer function from the virtual sound source 61 to the right ear hole of the listener, and H41 is the transfer function from the virtual sound source 61 to the left ear hole of the listener.

A transfer function X4 of the filter 210 and a transfer function Y4 of the filter 211 are designed to fulfill expressions (15) and (16). By thus designing the transfer functions X4 and Y4, the listener can correctly recognize the virtual sound source 62.

$$X4=(h4\cdot H32-h3\cdot H42)/(h1\cdot h4-h2\cdot h3) \quad \text{expression (15)}$$

$$Y4=(h1\cdot H42-h2\cdot H32)/(h1\cdot h4-h2\cdot h3) \quad \text{expression (16)}$$

Here, H32 is the transfer function from the virtual sound source 62 to the left ear hole of the listener, and H42 is the transfer function from the virtual sound source 62 to the right ear hole of the listener.

EXAMPLE 3

A headphone system 103 according to a third example of the present invention will be described with reference to FIGS. 8A through 9.

Figure 9:
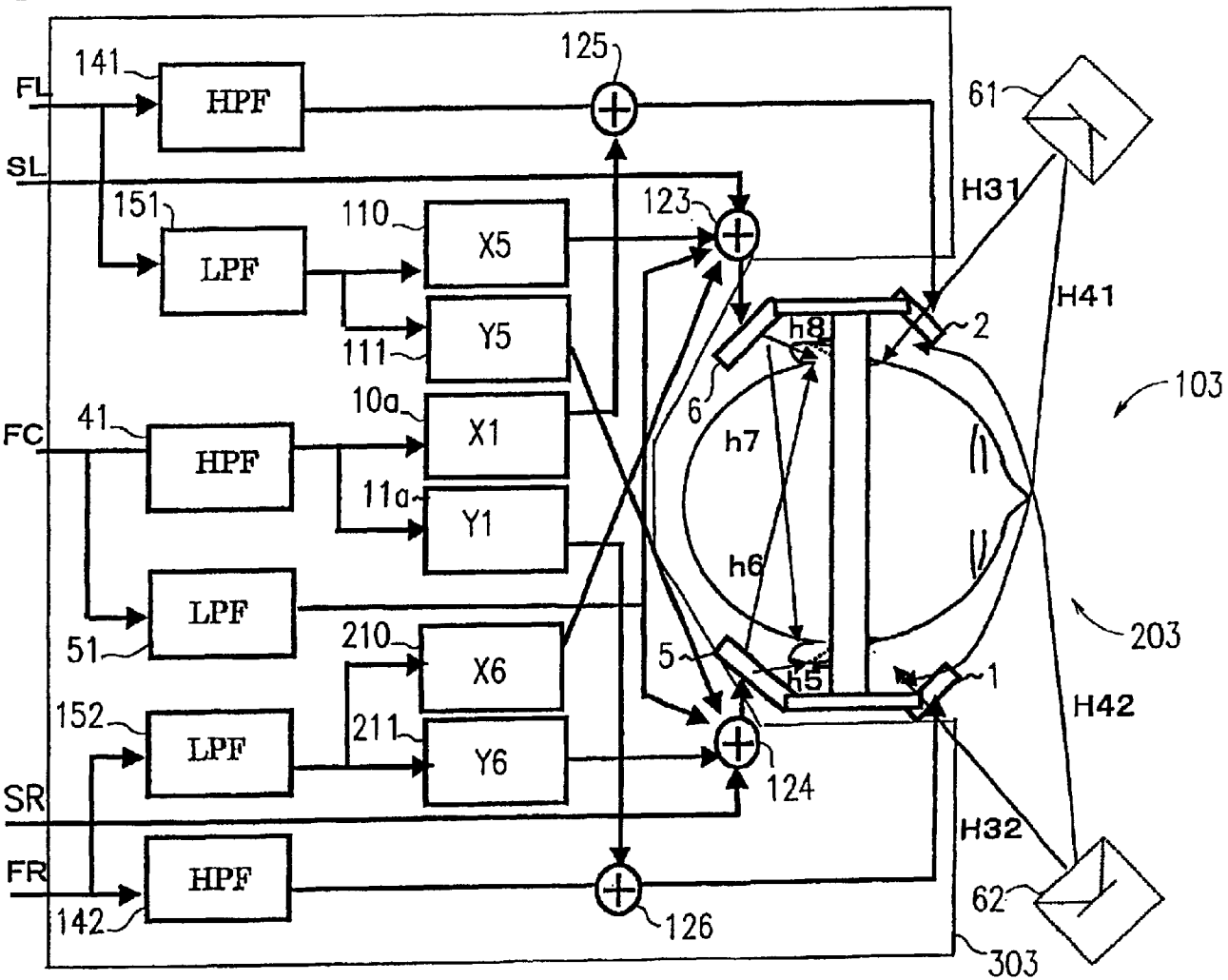
FIG. 9 is a block diagram of a headphone system 103 according to the third example of the present invention, illustrating a structure of a signal processing circuit 303.

FIG. 9 shows a structure of the headphone system 103. The headphone system 103 includes a headphone 203 and a signal processing circuit 303 for outputting an acoustic signal to the headphone 203.

Figure 8A:
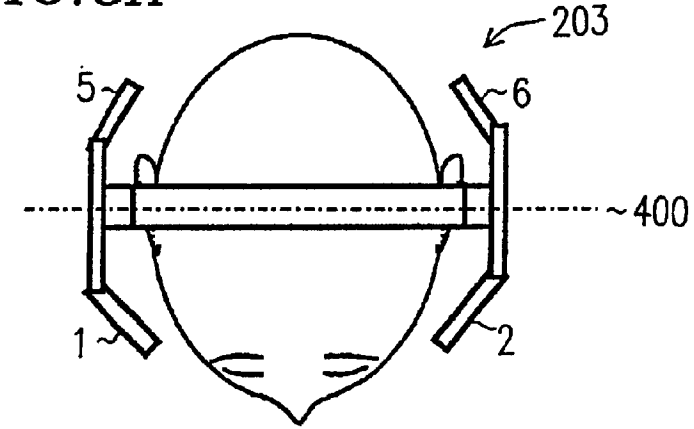
FIGS. 8A, 8B and 8C are a top view, a front view and a side view of a headphone 203 according to a third example of the present invention.
Figure 8B:
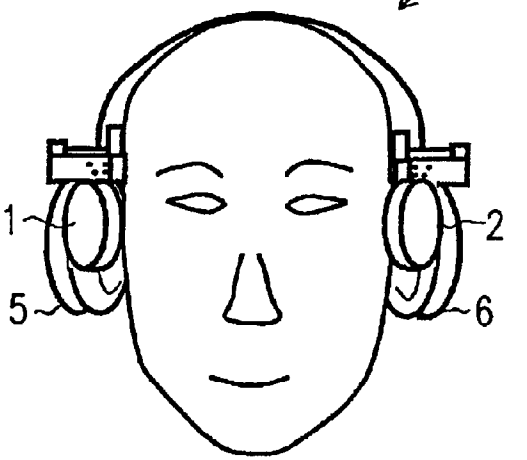
Figure 8C:
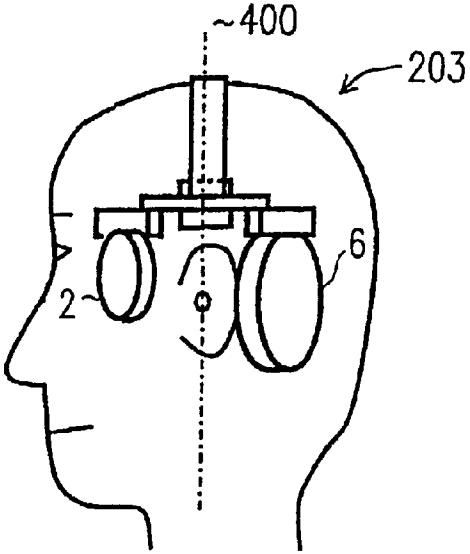

FIGS. 8A, 8B and 8C show a structure of the headphone 203. FIG. 8A is a top view, FIG. 8B is a front view, and FIG. 8C is a side view of the headphone 203.

As shown in FIGS. 8A, 8B and 8C, the headphone 203 includes right ear speakers 1 and 5, left ear speakers 2 and 6, and a support 8 for supporting the speakers 1, 2, 5 and 6.

As according to the first example, the support 8 supports the speakers 1, 2, 5 and 6 so as to fulfill the following conditions (1) through (3).

Condition (1): The speakers 1 and 2 are located forward with respect to the vertical plane 400.

Condition (2): The speakers 5 and 6 are located rearward with respect to the vertical plane 400.

Condition (3): The speakers 1, 2, 5 and 6 are located out of contact with the right and left ears of the listener.

According to the third example of the present invention, among acoustic signals for causing the listener to recognize a sound source located in front of the listener, acoustic signals having a frequency of the prescribed frequency fi or lower are reproduced using the speakers 5 and 6 located rearward with respect to the vertical plane 400. Among the acoustic signals for causing the listener to recognize a sound source located in front of the listener, acoustic signals having a frequency of the prescribed frequency fi or higher are reproduced using the speakers 1 and 2 located forward with respect to the vertical plane 400.

The prescribed frequency fi is set in a similar manner to that according to the second example.

By such a system in which a part of the acoustic signals for causing the listener to recognize the sound source located in front of the listener are reproduced using the speakers 5 and 6, the speakers 1 and 2 can be reduced in size and weight.

In this system, the acoustic signals for causing the listener to recognize a sound source located behind the listener are reproduced using the speakers 5 and 6 which are located rearward with respect to the vertical plane 400.

FIG. 9 shows a structure of the signal processing circuit 303. The signal processing circuit 303 outputs, among acoustic signals for causing the listener to recognize a sound source located in front of the listener, acoustic signals having a frequency of fi or higher to the speakers 1 and 2. The signal processing circuit 302 outputs, among the acoustic signals for causing the listener to recognize a sound source located in front of the listener, acoustic signals having a frequency of fi or lower to the speakers 5 and 6.

In FIG. 9, identical elements previously discussed with respect to FIG. 2 and 7 bear identical reference numerals and the descriptions thereof will be omitted. In FIG. 9, the virtual sound source 61 is to the front left of the listener, and the virtual sound source 62 is located to the front right of the listener.

The signal processing circuit 303 includes a high pass filters (HPF) 41 for allowing signals having a frequency component of fi or higher, and a low pass filter (LPF) 51 for allowing signals having the frequency component of fi or lower, in addition to the HPFs 141 and 142 and the LPFs 151 and 152. The signal processing circuit 303 also includes the filters 110, 111, 10*a*, 11*a*, 210 and 211, and adders 123, 124, 125 and 126.

The FL signal is input to the HPF 141. The output from the HPF 141 is input to the adder 125. The FL signal is also input to the LPF 151. The output from the LPF 151 is input to the filters 110 and 111.

The FR signal is input to the HPF 142. The output from the HPF 142 is input to the adder 126. The FL signal is also input to the LPF 152. The output from the LPF 152 is input to the filters 210 and 211.

The FC signal is input to the HPF 41 and the LPF 51. The output from the HPF 41 is input to the filters 10*a* and 11*a*. The output from the HPF 51 is input to the adders 123 and 124.

The adder 125 adds the output from the HPF 141 and the output from the filter 10*a*, and outputs the addition result to the speaker 2.

The adder 123 adds the SL signal, the output from the filter 110, the output from the LPF 51, and the output from the filter 210; and outputs the addition result to the speaker 6.

The adder 124 adds the output from the filter 111, the output from the LPF 51, the output from the filter 211, and the SR signal; and outputs the addition result to the speaker 5.

The adder 126 adds the output from the HPF 142 and the output from the filter 11*a*, and outputs the addition result to the speaker 1.

EXAMPLE 4

A headphone system according to a fourth example of the present invention will be described with reference to FIG. 10A through FIG. 14B.

The headphone system according to the fourth example includes a headphone 204 and a signal processing circuit (not shown) for outputting an acoustic signal to the headphone 204.

Figures 10A, 10B, 10C:
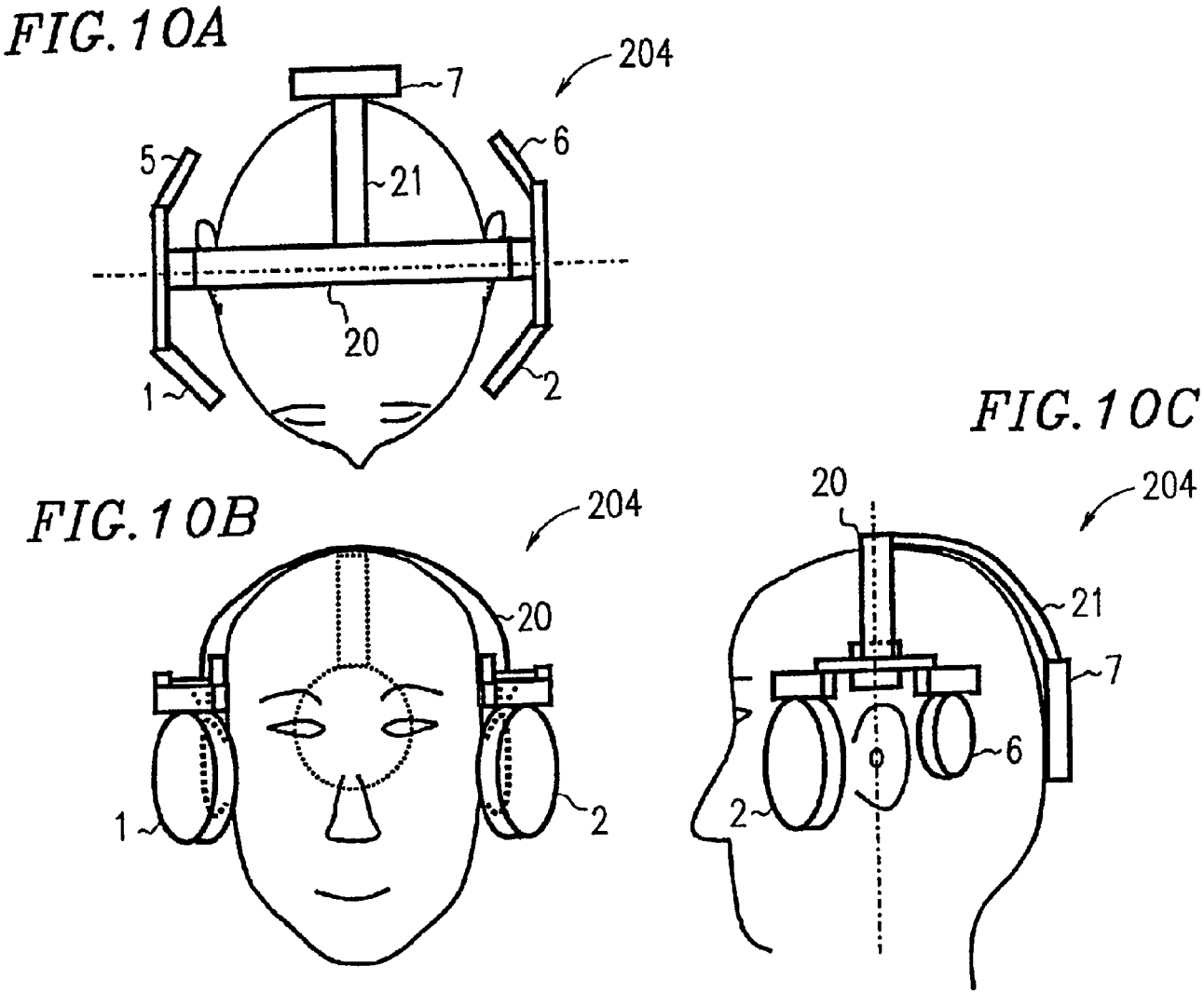
FIGS. 10A, 10B and 10C are a top view, a front view and a side view of a headphone 204 according to a fourth example of the present invention, showing a low frequency-dedicated speaker 7 provided in the vicinity of a rear part of the head of the listener.

As shown in FIGS. 10A, 10B and 10C, the headphone 204 includes a low frequency-dedicated speaker 7 for only reproducing acoustic signals in a low frequency band, in addition to the elements described in the first through third examples.

In the first through third examples, the speakers are located out of contact with the ears of the listener. In this case, the reproduction level of the acoustic signals in the low frequency band is likely to be lowered. The low frequency-dedicated speaker 7 is provided for compensating for such a reduction in the reproduction level of the acoustic signals. Thus, acoustic signals in a wide frequency band can be satisfactorily reproduced by the headphone 204.

In the low frequency band, the wavelength of acoustic signals is relatively long. Therefore, the front transfer function and the rear transfer function have almost no difference from each other. There is almost no individual difference in the transfer functions, either. Accordingly, the headphone 204 can have the low frequency-dedicated speaker 7 at various positions thereof.

FIGS. 10A, 10B and 10C show an example of providing the low frequency-dedicated speaker 7 in the vicinity of an upper rear part of the head of the listener. In this example, the headphone 204 includes a support assisting member 21 attached to the headphone band 20. The support assisting member 21 supports the low frequency-dedicated speaker 7 so as to be located in the vicinity of the upper rear part of the head of the listener.

Figure 11A:
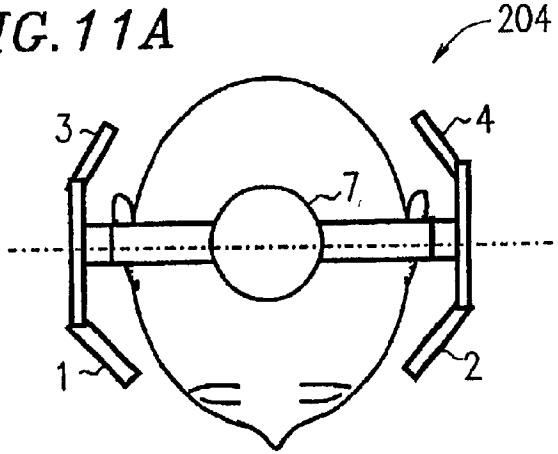
FIGS. 11A, 11B and 11C are a top view, a front view and a side view of the headphone 204 according to the fourth example of the present invention, showing the low frequency-dedicated speaker 7 provided in the vicinity of the top of the head of the listener.
Figure 11B:
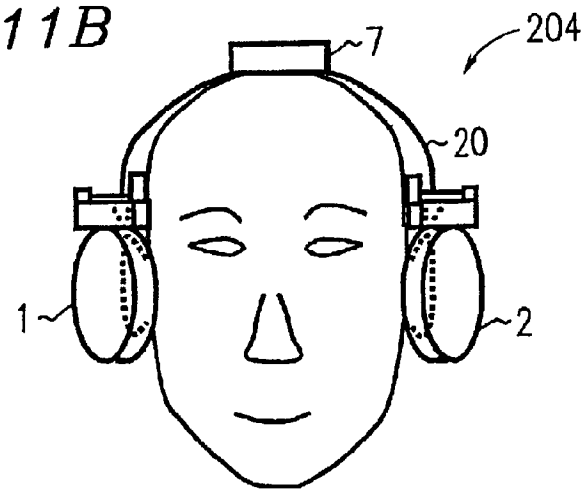
Figure 11C:
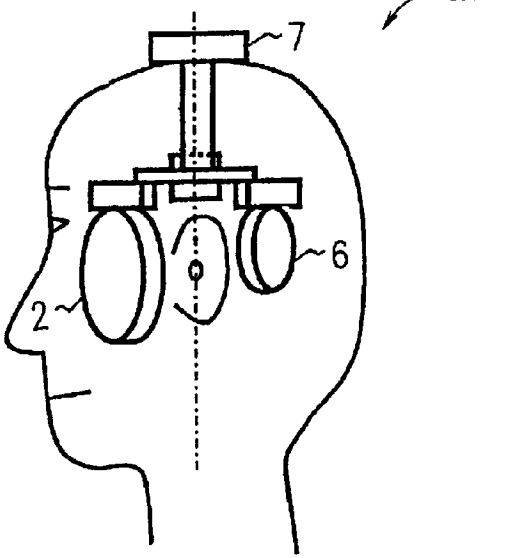

FIGS. 11A, 11B and 11C show an example of providing the low frequency-dedicated speaker 7 in the vicinity of the top of the head of the listener. In this example, the low frequency-dedicated speaker 7 is directly attached to the headphone band 20 so as to be located in the vicinity of the top of the head of the listener.

Figure 12A:
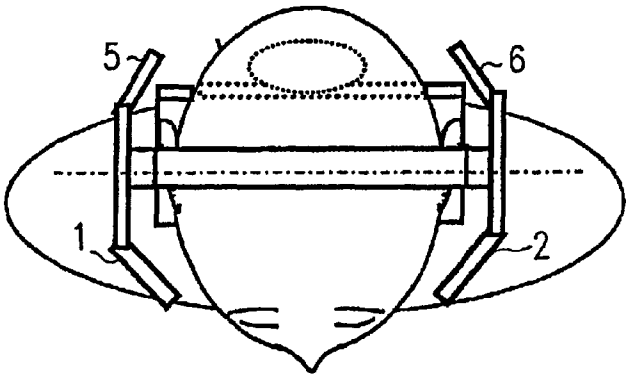
FIGS. 12A, 12B and 12C are a top view, a front view and a side view of the headphone 204 according to the fourth example of the present invention, showing the low frequency-dedicated speaker 7 provided in the vicinity of another rear part of the head of the listener.
Figure 12B:
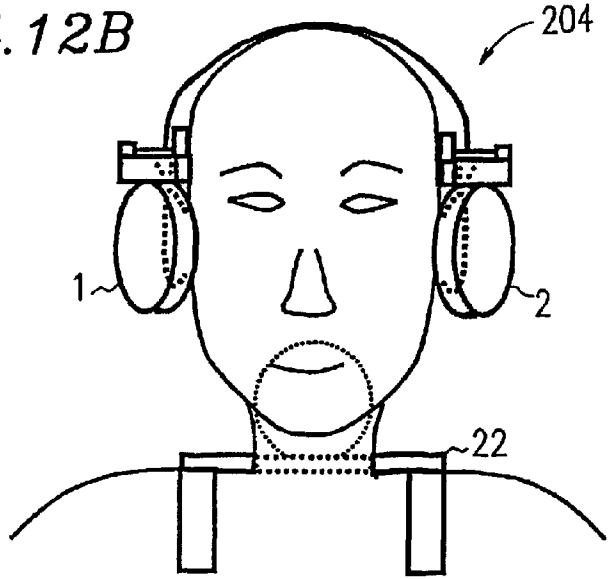
Figure 12C:
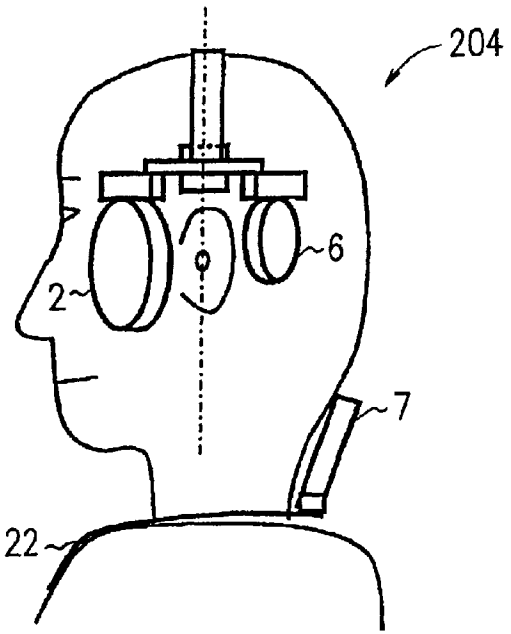

FIGS. 12A, 12B and 12C show an example of providing the low frequency-dedicated speaker 7 in the vicinity of a lower rear part of the head of the listener. In this example, the headphone 204 includes a support assisting member 22 which is attachable on the shoulders of the listener. The support assisting member 22 supports the low frequency-dedicated speaker 7 so as to be located in the vicinity of the lower rear part of the head of the listener.

In the example shown in FIGS. 10A, 10B and 10C, it is more preferable that the contact area of the support assisting member 21 and the head of the listener is larger in order to stabilize the low frequency-dedicated speaker 7.

Figure 13A:
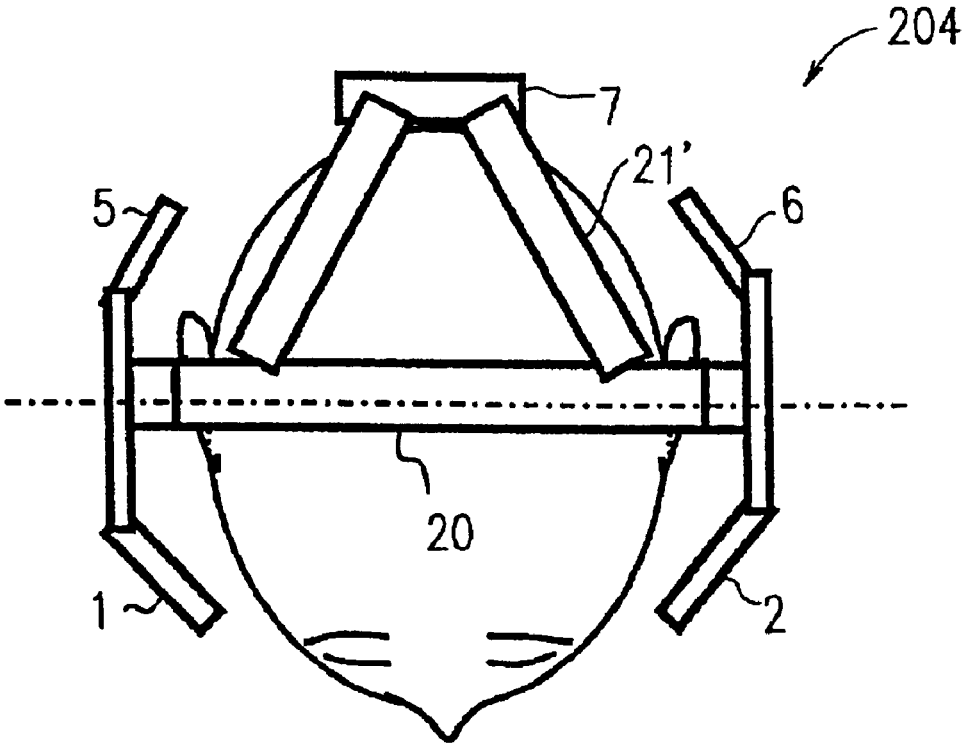
FIGS. 13A and 13B are a top view and a front view of the headphone 204 including a support assisting member 21' having an improved shape.
Figure 13B:
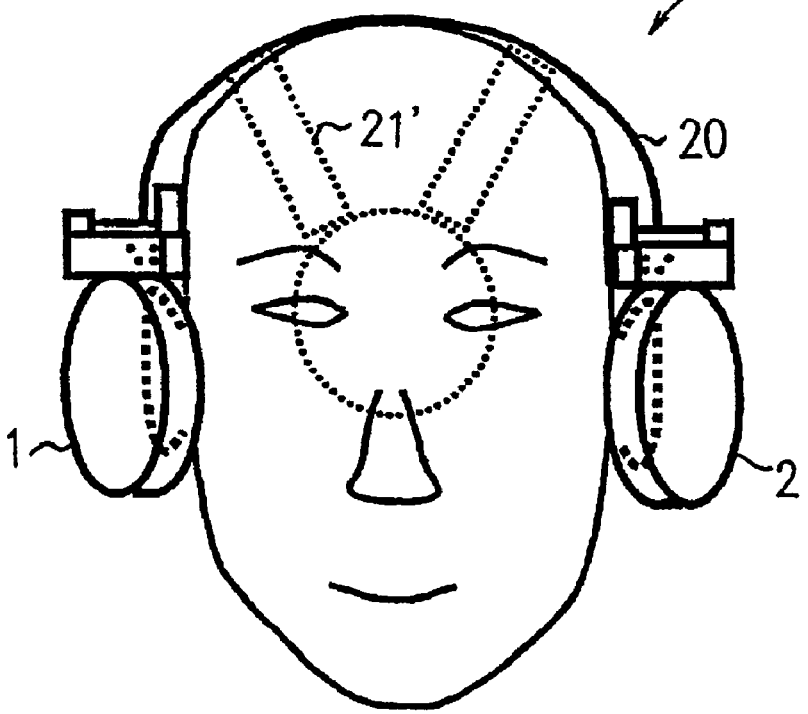
Figure 14A:
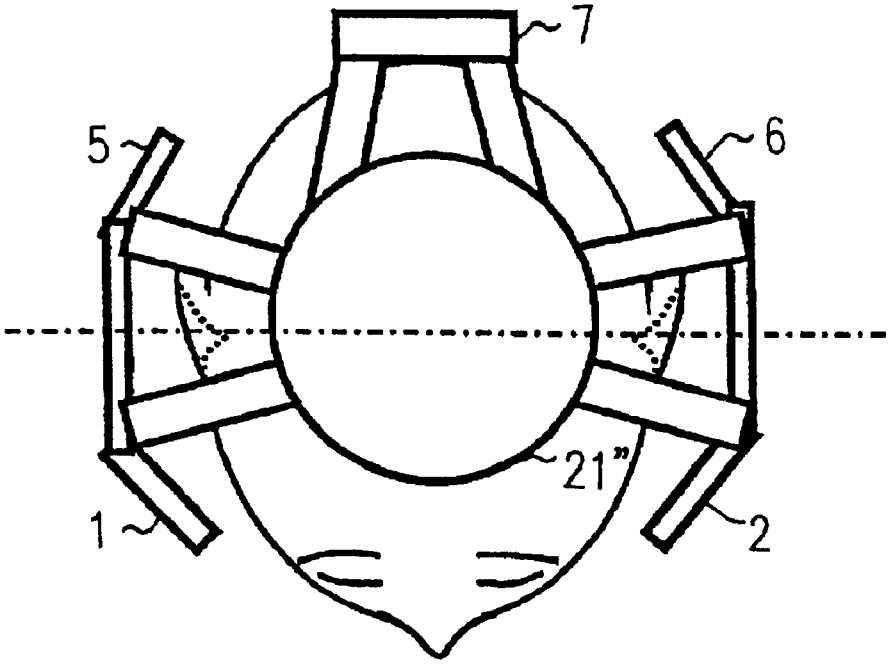
FIGS. 14A and 14B are a top view and a front view of the headphone 204 including a support assisting member 21" having another improved shape.
Figure 14B:
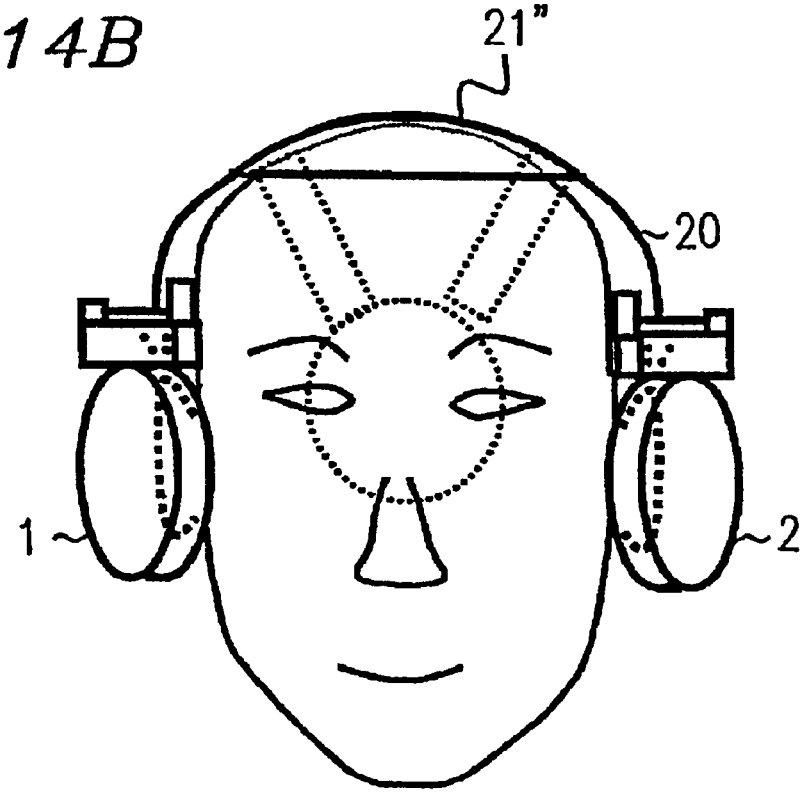

FIGS. 13A and 13B show a support assisting member 21' having an improved shape so as to increase the contact area with the head of the listener. FIGS. 14A and 14B show a support assisting member 21" having another improved shape so as to increase the contact area with the head of the listener.

The signal processing circuit is structured to output to the low frequency-dedicated speaker 7 a signal for reproducing only the acoustic signals in the low frequency band.

As described above, according to the fourth example, the reduction in the low frequency reproduction ability of the speakers which are located out of contact with the ears of the listener can be compensated for by providing a low frequency-dedicated speaker.

EXAMPLE 5

A headphone system according to a fifth example of the present invention will be described with reference to FIGS. 15A, 15B and 15C.

The headphone system according to the fifth example includes a headphone 205 and a signal processing circuit (not shown) for outputting an acoustic signal to the headphone 205.

Figure 15A:
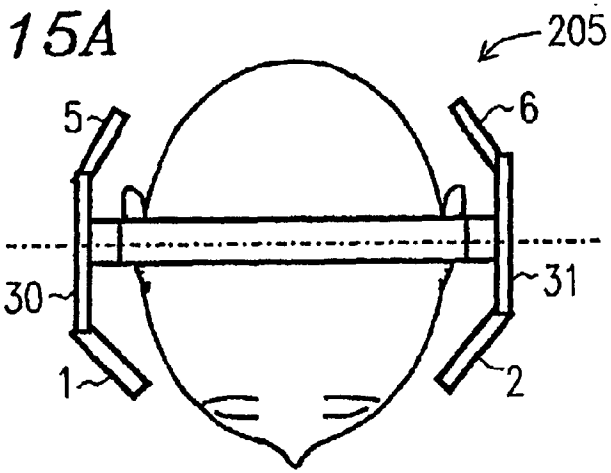
FIGS. 15A, 15B and 15C are a top view, a front view and a side view of a headphone 205 according to a fifth example of the present invention, including diaphragms 10 and 11.
Figure 15B:
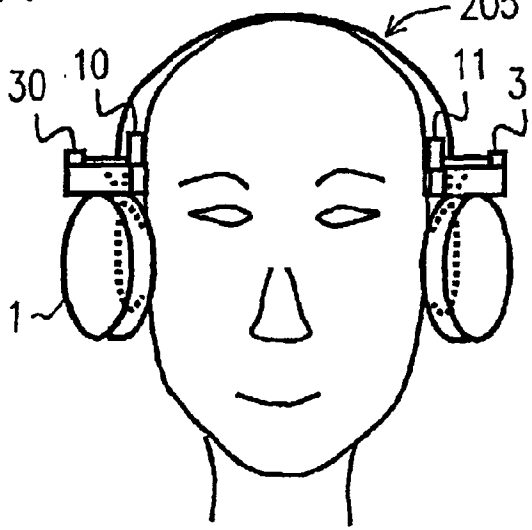
Figure 15C:
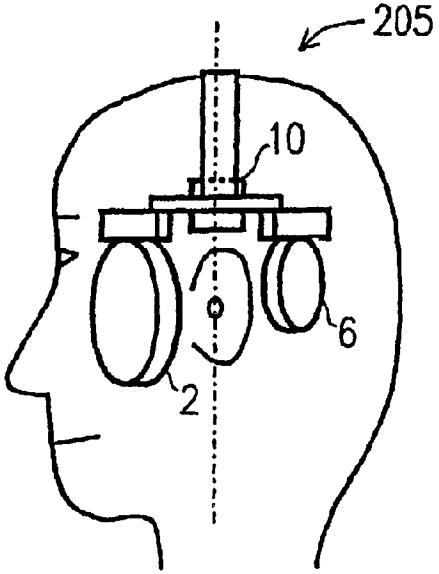

FIGS. 15A, 15B and 15C are a top view, a front view and a side view of the headphone 205.

As shown in FIGS. 15A, 15B and 15C, the headphone system according to the fifth example includes vibration units 10 and 11 in addition to the elements of the headphones 201 through 203 described in the first through third examples. The vibration units 10 and 11 vibrate based on a dedicated low frequency band signal used for reproducing only the audio signals in a low frequency band.

In the first through third examples, the speakers are located out of contact with the ears of the listener. In this case, the reproduction level of the acoustic signals in the low frequency band is likely to be lowered. The vibration units 10 and 11 are provided for compensating for such a reduction in the reproduction level of the acoustic signals. Thus, acoustic signals in a wide frequency band can be satisfactorily reproduced by the headphone 205.

In the example shown in FIGS. 15A, 15B and 15C, the vibration unit 10 is provided between the speaker supporting member 30 and one temporal region of the head of the listener, and the vibration unit 11 is provided between the speaker supporting member 31 and the other temporal region of the head of the listener.

The speaker supporting member 30 supports the speakers 1 and 5. The speaker supporting member 31 supports the speakers 2 and 6. The speaker supporting members 30 and 31 are connected to each other through a headphone band 20.

The vibration units 10 and 11 are provided to be in close contact with the temporal regions of the head. The vibration of the vibration units 10 and 11 is conveyed to the bones of skull. As a result, bone conduction is generated. Thus, the listener can recognize the sound in the low frequency band.

The headphone 205 has another advantage that since the vibration units 10 and 11 are provided to be in close contact with the temporal regions of the head, the headphone 205 is unlikely to slip down from the head of the listener.

The signal processing circuit included in the headphone system according to the fifth example is structured to output a dedicated low frequency band signal to the vibration units 10 and 11.

As described above, according to the fifth example, the reduction in the low frequency ability of the speakers which are located out of contact with the ears of the listener can be compensated for by providing the vibration units.

EXAMPLE 6

A headphone system according to a sixth example of the present invention will be described with reference to FIGS. 16 and 17.

The headphone system according to the sixth example includes a headphone 206 and a signal processing circuit (not shown) for outputting an acoustic signal to the headphone 206.

The headphone 206 has the same structure as that of any of the headphones 201 through 205 described in the first through fifth examples.

According to the sixth example, the speakers 3 and 4 are located rearward with respect to the vertical plane 400 so that the angle made between a straight line 40, which is in the straight ahead direction of the listener (i.e., perpendicular to the vertical plane 400), and vertical lines 45 which, respectively, run through the centers of the front surfaces of the speakers 3 and 4 and are vertical to the front surfaces of the speakers 3 and 4 is in the range of about 100 degrees and about 120 degrees.

By providing the speakers 3 and 4, the listener can recognize the rear sound source in the range of about 100 degrees and about 120 degrees from the straight line 40. This matches the standards BS.775 recommended by the International Telecommunication Union (ITU). Due to such a structure, the listener can recognize the rear sound source while sensing a preferable expansion of the sound.

Figure 16:
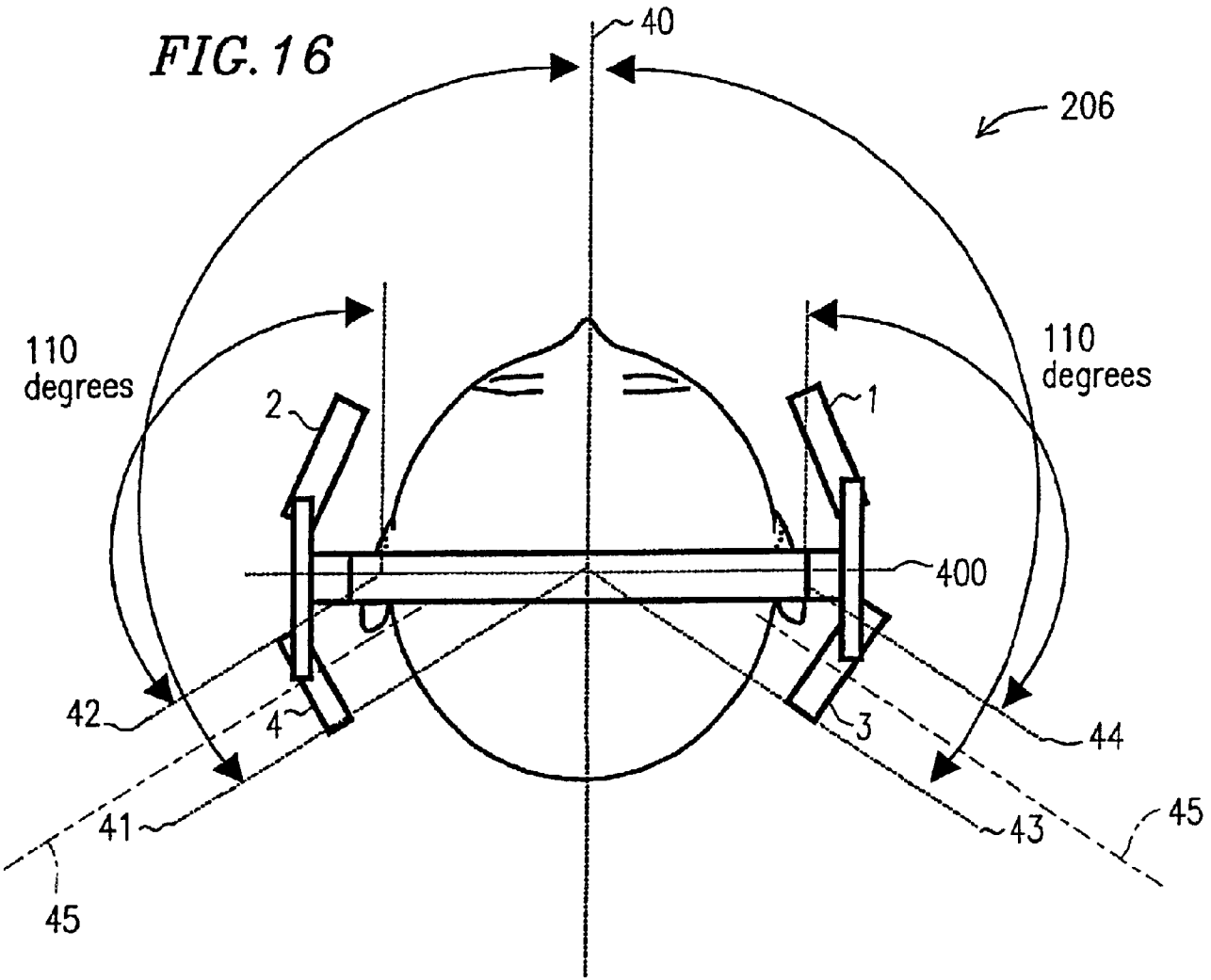
FIG. 16 is a top view of a headphone 206 according to a sixth example of the present invention.

In the example of FIG. 16, the speakers 3 and 4 are provided so that the angle made between the straight line 40 and the line running through the center of the front surface of the speakers 3 and 4 is about 110 degrees.

In FIG. 16, the line 41 makes an angle of about 110 degrees with the straight line 40 and runs through the center of the head of the listener. The line 42 makes an angle of about 110 degrees with the straight line 40 and runs through the left ear hole of the listener. The speaker 4 is provided so that the line running through the center of the front surface of the speaker 4 is parallel to the lines 41 and 42.

The line 43 makes an angle of about 110 degrees with the straight line 40 and runs through the center of the head of the listener. The line 44 makes an angle of about 110 degrees with the straight line 40 and runs through the right ear hole of the listener. The speaker 3 is provided so that the line running through the center of the front surface of the speaker 3 is parallel to the lines 43 and 44.

Figure 17:
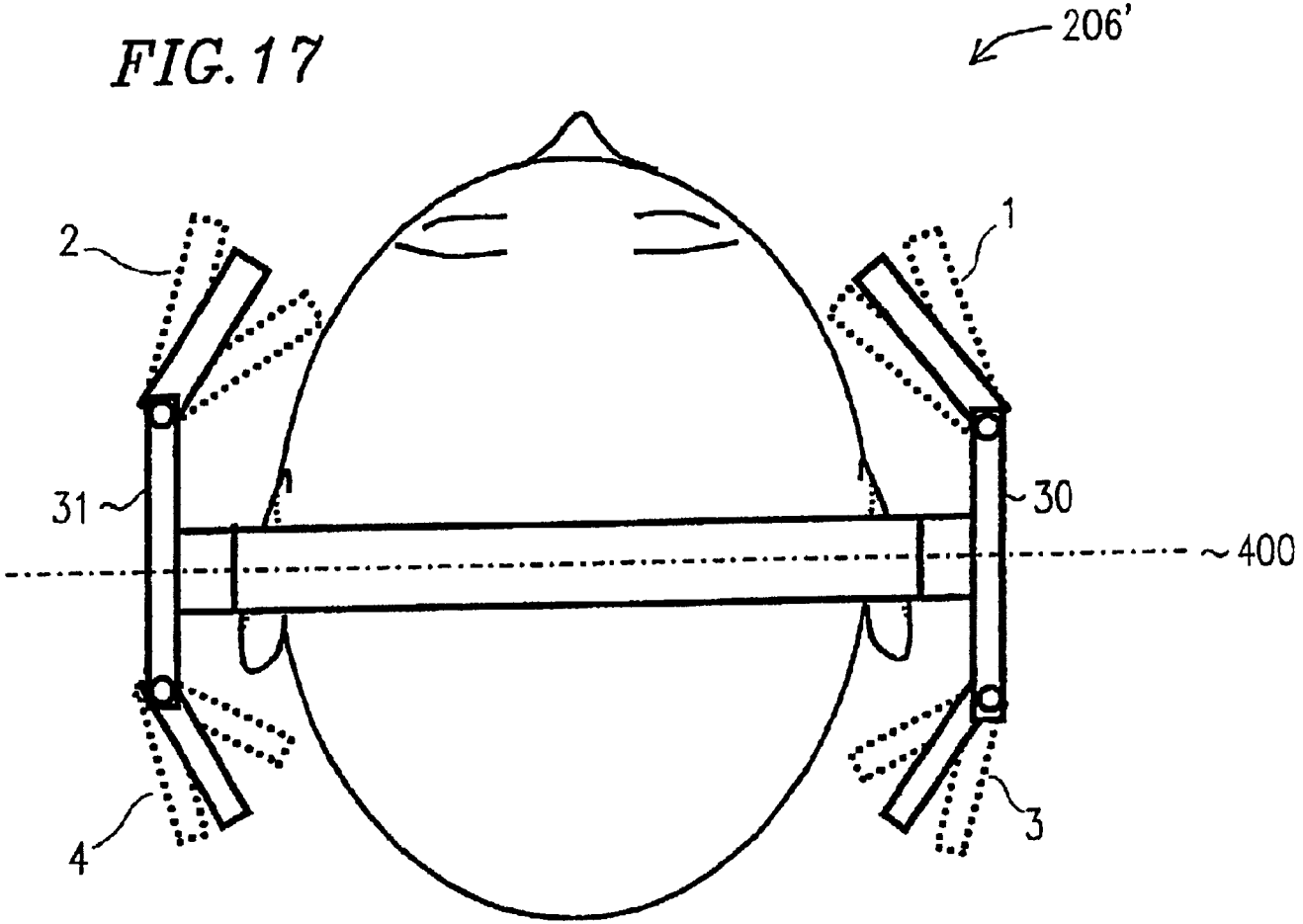
FIG. 17 is a top view of another headphone 206' according to the sixth example of the present invention.

FIG. 17 shows a headphone 206' including an angle adjusting mechanism for adjusting the angle of the speakers 1 through 4 with respect to the listener.

In the example shown in FIG. 17, the headphone 206' includes a speaker supporting member 30 for supporting the speakers 1 and 3, and a speaker supporting member 31 for supporting the speakers 2 and 4.

The speaker 1 and the speaker supporting member 30 are connected to each other through a hinge mechanism. Similarly, the speaker 3 and the speaker supporting member 30, the speaker 2 and the speaker supporting member 31, and the speaker 4 and the speaker supporting member 31 are connected to each other through a hinge mechanism. Namely, the speakers 1 through 4 are rotatably supported about the connecting portions.

By providing the angle adjusting mechanism shown in FIG. 17, the angle made between the straight head direction of the listener (the direction of the straight line 40 in FIG. 16) and the line running through the center of the front surface of each of the speakers 1 through 4 can be set to be in the above-described preferable range.

Such a mechanism also facilitates compensating for the undesirable deviation of the positions of the speakers and the ears of the listener due to the difference between different individuals.

The listener can select his/her favorite sound field perception by adjusting the angle made by the straight ahead direction of the listener and the lines running through the centers of the front surfaces of the speakers 1 and 2 located forward with respect to the vertical plane 400.

The speakers 1 and 2 may be fixed with respect to the listener while the speakers 3 and 4 are adjustable. Alternatively, the speakers 3 and 4 may be fixed with respect to the listener while the speakers 1 and 2 are adjustable.

As described above, according to the sixth example, the listener can recognize the sound field more accurately in multi-channel reproduction by setting in a prescribed range the angle made between the straight ahead direction of the listener and the lines running through the centers of the front surfaces of the speakers 3 and 4 which are located rearward with respect to the listener.

EXAMPLE 7

A headphone system according to a seventh example of the present invention will be described with reference to FIGS. 18A, 18B and 18C.

The headphone system according to the seventh example includes a headphone 207 and a signal processing circuit (not shown) for outputting an acoustic signal to the headphone 207.

Figure 18A:
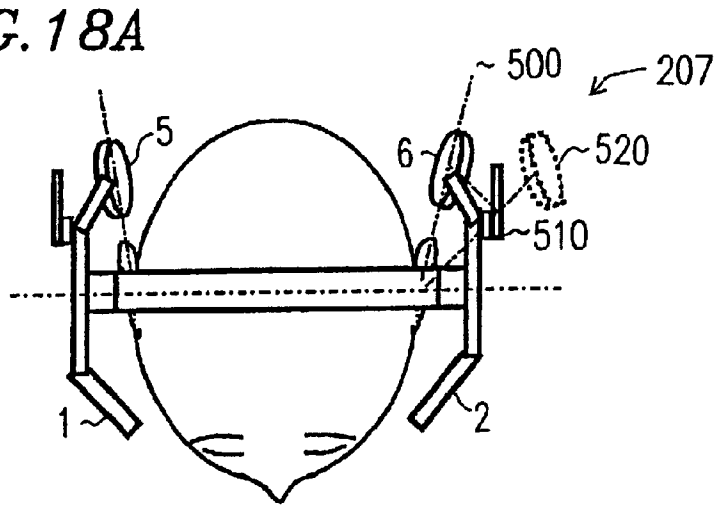
FIGS. 18A, 18B and 18C are a top view, a front view and a side view of a headphone 207 according to a seventh example of the present invention.
Figure 18B:
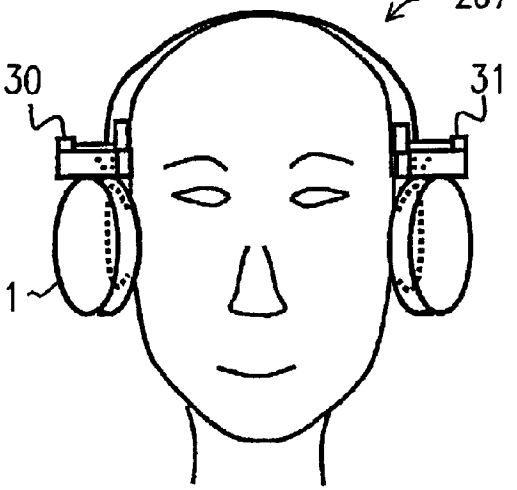
Figure 18C:
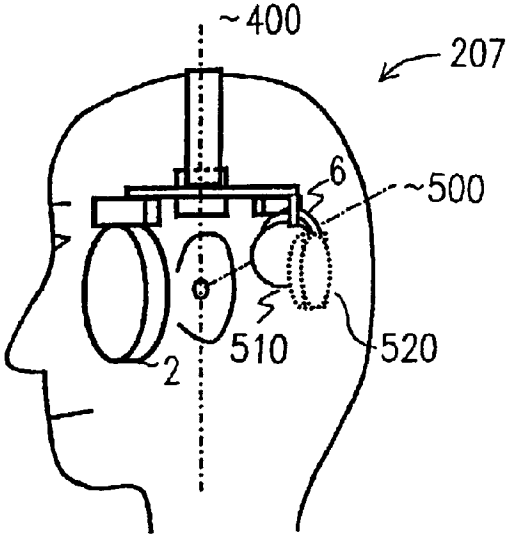

FIGS. 18A, 18B and 18C are a top view, a front view and a side view of the headphone 207.

As shown in FIGS. 18A, 18B and 18C, the headphone 207 includes a reflection plate 510 for reflecting the sound radiating from the speaker 6.

As shown in FIG. 18A, the speaker 6 is located so that the surface of the diaphragm of the speaker 6 includes a straight line 500 which connects the left ear hole of the listener and the center of the speaker 6. The sound radiating from the speaker 6 is reflected by the reflection plate 510 and reaches the left ear of the listener.

By thus providing the speaker 6 and the reflection plate 510, the sound transmitted forward with respect to the speaker 6 along the straight line 500 and the sound transmitted rearward with respect to the speaker 6 along the straight line 500 counteract each other and are reduced in amplitude on the straight line 500. The sound, radiating from the speaker 6 in the straight ahead direction of the speaker 6 and reflected by the reflection plate 510, reaches the left ear of the listener without being reduced. Therefore, the listener can recognize the sound as if the sound radiated from a virtual speaker 520.

The rear surface of the speaker 6 is acoustically open.

Another reflecting plate may be provided for reflecting the sound radiating from the speaker 5, and the speaker 5 may be positioned like the speaker 6.

According to the seventh example, the listener can recognize the acoustic image of the virtual speaker which is relatively far from the head of the listener, using the speakers 5 and 6 located near the head of the listener. As a result, the headphone 207 can be reduced in size.

According to the present invention, a first speaker and a second speaker are provided forward with respect to a vertical plane including the straight line connecting the right ear hole and the left ear hole of the listener, and a third speaker and a fourth speaker are provided rearward with respect to the vertical plane. The first through fourth speakers are located out of contact with the right and left ears of the listener.

By providing the first through fourth speakers in the above-described manner, an acoustic signal from the first speaker and an acoustic signal from the third speaker separately reach the right ear of the listener along the shape of his/her head. An acoustic signal from the second speaker and an acoustic signal from the fourth speaker separately reach the left ear of the listener along the shape of his/her head. This means that the information on the transfer function in front of and behind the individual listener is provided to the listener. As a result, the listener can correctly recognize a virtual sound source in front of or behind him/her regardless of the difference between the recognizing abilities of different individuals.

In one embodiment of the invention, among acoustic signals for causing the listener to recognize a sound source behind the listener, acoustic signals having a frequency of a prescribed frequency fi or lower are output to the first and second speakers, and acoustic signals having a frequency of the prescribed frequency fi or higher are output to the third and fourth speakers.

By reproducing a part of the acoustic signals for causing the listener to recognize a sound source behind the listener, using the first and second speakers in this manner, the third and fourth speakers can be reduced in size and weight.

The first and second speakers are preferably located rearward with respect to a vertical plane including a straight line connecting the right eye and the left eye of the listener. By such an arrangement, the first and second speakers can be prevented from being in the field of vision of the listener. As a result, the listener can enjoy the video displayed on the large-scale screen without being disturbed by the first and second speakers.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A headphone system, comprising:

a headphone; and a signal processing circuit for outputting an acoustic signal to the headphone, wherein the headphone includes:

a first speaker and a third speaker for a right ear of a listener, a second speaker and a fourth speaker for a left ear of the listener, and a support for supporting the first through fourth speakers so that the first and second speakers are located forward with respect to a vertical plane including a straight line connecting the hole of the right ear and the hole of the left ear of the listener, the third and fourth speakers are located rearward with respect to the vertical plane, and the first through fourth speakers are out of contact with the right ear and the left ear of the listener;

wherein the signal processing circuit utilizes transfer function correction coefficients which may be varied to correct for individual differences among different listeners to allow each of the different listeners to more correctly recognize a virtual sound source imaged by the sneakers.

2. A headphone system according to claim 1, wherein the signal processing circuit outputs an acoustic signal, for causing the listener to recognize a front sound source located forward with respect to the listener, to the first and second speakers.

3. A headphone system according to claim 1, wherein the signal processing circuit outputs an acoustic signal, for causing the listener to recognize a rear sound source located rearward with respect to the listener, to the third and fourth speakers.

4. A headphone system according to claim 1, wherein the signal processing circuit outputs, among acoustic signals for causing the listener to recognize a rear sound source, acoustic signals having a frequency of a prescribed frequency fi or lower to the first and second speakers, and outputs acoustic signals having a frequency of the prescribed frequency fi or higher to the third and fourth speakers.

5. A headphone system according to claim 1, wherein the signal processing circuit outputs, among acoustic signals for causing the listener to recognize a front sound source, acoustic signals having a frequency of a prescribed frequency fi or higher to the first and second speakers, and outputs acoustic signals having a frequency of the prescribed frequency fi or lower to the third and fourth speakers.

6. A headphone system according to claim 1, wherein the first and second speakers are located rearward with respect to a vertical plane including a straight line connecting a right eye and a left eye of the listener.

7. A headphone system according to claim 1, wherein the third speaker is located so that an angle between a straight line straight ahead direction of the listener and a vertical line running through the center of a front surface of the third speaker is in the range of about 100 degrees to about 120 degrees, and the fourth speaker is located so that an angle between the straight line in the straight ahead direction of the listener and a vertical line running through the center of a front surface of the fourth speaker is in the range of about 100 degrees to about 120 degrees.

8. A headphone system according to claim 1, wherein the headphone further includes a low frequency-dedicated speaker for reproducing only audio signals in a low frequency band.

9. A headphone system according to claim 8, wherein the low frequency-dedicated speaker is located in the vicinity of a rear part of the head of the listener, when the headphone is worn.

10. A headphone system according to claim 8, wherein the low frequency-dedicated speaker is located in the vicinity of the top of the head of the listener, when the headphone is worn.

11. A headphone system according to claim 1, wherein the headphone further includes a vibration unit for vibrating based on a dedicated low frequency band signal used for reproducing only audio signals in a low frequency band, and the vibration unit is supported so as to be in close contact with a temporal region of the head of the listener, when the headphone is worn.

12. A headphone system according to claim 1, wherein:

the support includes a first supporting member for supporting the first and third speakers and a second supporting member for supporting the second and fourth speakers, the third speaker and the first supporting member are connected through a first connecting portion so that the third speaker is rotatable about the first connecting portion, and the fourth speaker and the second supporting member are connected through a second connecting portion so that the fourth speaker is rotatable about the second connecting portion.

13. A headphone system according to claim 1, wherein:

the headphone further includes a first reflection plate for reflecting sound radiating from the third speaker and a second reflection plate for reflecting sound radiating from the fourth speaker, the third speaker is located so that a surface of a diaphragm of the third speaker includes a straight line connecting the hole of the right ear of the listener and the center of the third speaker, and the sound radiating from the third speaker and reflected by the first reflection plate reaches the right ear of the listener, and the fourth speaker is located so that a surface of a diaphragm of the fourth speaker includes a straight line connecting the hole of the left ear of the listener and the center of the fourth speaker, and the sound radiating from the fourth speaker and reflected by the second reflection plate reaches the left ear of the listener.

* * * * *

UNITED STATES PATENT AND TRADEMARK OFFICE

CERTIFICATE OF CORRECTION

PATENT NO. : 6,944,309 B2
DATED : September 13, 2005
INVENTOR(S) : Kenichi Terai It is certified that error appears in the above-identified patent and that said Letters Patent is hereby corrected as shown below:

Column 17,
Line 25, delete “speakers” and insert therefor -- sneakers --.

Signed and Sealed this

Thirteenth Day of December, 2005

JON W. DUDAS
*Director of the United States Patent and Trademark Office*